US007350653B2

(12) United States Patent
Belden, Jr.

(10) Patent No.: US 7,350,653 B2
(45) **Date of Patent: *Apr. 1, 2008**

(54) BOTTLE SECURITY DEVICE

(75) Inventor: Dennis D. Belden, Jr., Waxhaw, NC (US)

(73) Assignee: Checkpoint Systems, Inc., Thorofare, NJ (US)

( * ) Notice: Subject to any disclaimer, the term of this patent is extended or adjusted under 35 U.S.C. 154(b) by 280 days.

This patent is subject to a terminal disclaimer.

(21) Appl. No.: 11/246,464

(22) Filed: Oct. 7, 2005

(65) Prior Publication Data

US 2006/0043050 A1 Mar. 2, 2006

Related U.S. Application Data

(62) Division of application No. 10/626,970, filed on Jul. 25, 2003, now Pat. No. 7,004,340.

(51) Int. Cl.
*B65D 45/32* (2006.01)
*B65D 55/12* (2006.01)

(52) U.S. Cl. ..... 215/215; 215/272; 215/293; 215/302; 220/210; 220/256.1; 220/284

(58) Field of Classification Search ..... 215/215, 215/272, 293, 302, 206, 207, 218–221; 220/210, 220/256, 284, 259.3
See application file for complete search history.

(56) References Cited

U.S. PATENT DOCUMENTS

| | | | |
|---|---|---|---|
| 445,755 | A | 2/1891 | King |
| 654,533 | A | 7/1900 | Garner |
| 770,387 | A | 9/1904 | Richards |
| 783,885 | A | 2/1905 | McDougall |
| 809,213 | A | 1/1906 | Osgood |
| 833,446 | A | 10/1906 | Degener |
| 880,723 | A | 3/1908 | Cumming |
| 1,343,962 | A | 6/1920 | Byrne |
| 1,937,295 | A | 11/1933 | Rettenmeyer |
| 2,418,039 | A | 3/1947 | Mays |
| 3,025,990 | A | 3/1962 | Pancrazi |
| 3,804,284 | A | 4/1974 | Moore et al. |
| 3,843,006 | A | 10/1974 | Naito et al. |

(Continued)

FOREIGN PATENT DOCUMENTS

| | | |
|---|---|---|
| AR | 203.305 | 8/1975 |

(Continued)

*Primary Examiner*—Anthony D. Stashick
*Assistant Examiner*—Niki M. Eloshway
(74) *Attorney, Agent, or Firm*—Sand & Sebolt

(57) ABSTRACT

A bottle security device includes an inner member, an intermediate member and an outer member that cooperate to lock the device on a bottle neck. The inner member includes a plurality of fingers adapted to fit under the bead on a bottle neck. The intermediate member slides over the inner member and forces the fingers against the bottle. The intermediate member includes a plurality of upwardly extending arms with inwardly projecting teeth that engage outwardly extending teeth on the inner member to lock the inner and intermediate members together. A key unlocks and rotates a rotatable member to separate the intermediate and inner members to unlock the device. Upon rotation of the cover cap, camming surfaces on the rotatable member engage the upwardly extending arms to move them radially outward to disengage them from the inner member.

31 Claims, 17 Drawing Sheets

U.S. PATENT DOCUMENTS

| | | | |
|---|---|---|---|
| 3,893,582 | A | 7/1975 | Kowalik |
| 3,944,102 | A | 3/1976 | Grau |
| 3,950,917 | A | 4/1976 | Choksi et al. |
| 4,056,209 | A | 11/1977 | Winkler et al. |
| 4,260,067 | A | 4/1981 | Andruchiw |
| 4,279,353 | A | 7/1981 | Honma |
| 4,570,810 | A | 2/1986 | Hawkins |
| 4,710,752 | A | 12/1987 | Cordery |
| 4,775,061 | A | 10/1988 | Coote |
| 5,085,332 | A | 2/1992 | Gettig et al. |
| 5,114,029 | A | 5/1992 | Gibilisco |
| 5,269,429 | A | 12/1993 | Schumacher |
| 5,303,835 | A | 4/1994 | Haber et al. |
| 5,386,924 | A | 2/1995 | Flinta et al. |
| 5,431,293 | A | 7/1995 | Piron |
| 5,433,329 | A | 7/1995 | Weinstein |
| 5,464,109 | A | 11/1995 | Greenwald |
| 5,519,381 | A | 5/1996 | Marsh et al. |
| 5,586,670 | A | 12/1996 | Greenwald |
| 5,602,530 | A | 2/1997 | Holmgren |
| 5,638,970 | A | 6/1997 | Garby et al. |
| 5,678,712 | A | 10/1997 | Rios |
| 5,732,836 | A | 3/1998 | Barker et al. |
| 5,749,484 | A | 5/1998 | Trout |
| 5,769,252 | A | 6/1998 | Volpe |
| 6,604,643 | B1 | 8/2003 | Michael et al. |
| 6,769,557 | B2 | 8/2004 | Michael et al. |
| 6,912,878 | B2 | 7/2005 | Belden, Jr. |

FOREIGN PATENT DOCUMENTS

| | | |
|---|---|---|
| AR | 212.291 | 6/1978 |
| AR | 214.228 | 5/1979 |
| AR | 227.988 | 12/1982 |
| AR | 235.976 | 10/1987 |
| AR | 239.915 | 12/1989 |
| AR | 246.914 | 10/1994 |
| DE | 2121739 | 11/1972 |
| DE | 2307205 | 8/1974 |
| DE | 3211387 | 9/1983 |
| EP | 0385540 | 9/1990 |
| EP | 0522679 | 1/1993 |
| EP | 0687635 | 12/1995 |
| FR | 2586231 | 2/1987 |
| FR | 2608285 | 6/1988 |
| GB | 677311 | 8/1952 |
| GB | 2082552 | 3/1982 |
| WO | WO 89-07076 | 8/1989 |
| WO | WO 91/04201 | 4/1991 |
| WO | WO 92/12067 | 7/1992 |
| WO | WO 94/08867 | 4/1994 |
| WO | WO 97/00819 | 1/1997 |
| WO | WO 99/67149 | 12/1999 |

| |
|---|
| FIG-2A |
| FIG-2B |

BOTTLE SECURITY DEVICE

CROSS REFERENCE TO RELATED APPLICATIONS

This application is a divisional application of U.S. patent application Ser. No. 10/626,970, filed Jul. 25, 2003 now U.S. Pat. No. 7,004,430; the disclosure of which is incorporated herein by reference.

BACKGROUND OF THE INVENTION

1. Technical Field

This invention relates to article security devices used by retail and similar stores and outlets. More particularly, the invention relates to electronic article surveillance security devices attachable to articles in a manner that makes the devices essentially impossible to remove or disable absent destruction of the devices or using keys that release the devices from the item on which they are secured. Specifically, the present invention is related to a bottle security device that holds an electronic article surveillance component where the bottle security device is configured to be received over the end of a typical bottle such as those bottles used to hold beer, wine, and liquor, in a manner that prevents its removal absent substantial damage to the bottle or bottle security device or the use of a corresponding key.

2. Background Information

The need to prevent, deter, stop, and/or catch shoplifters has become of increased concern to retail store owners. To meet this increasing demand, various forms of electronic article surveillance have been developed. One type of electronic article surveillance includes the use of a detector that is typically disposed about the exit and entrance to the retail establishment. The system utilizes electronic article surveillance (hereinafter EAS) tags that are attached to items in the retail store. An alarm may be activated when an EAS tag is passed in close proximity to the detector. Thus, if a shoplifter attempts to take an article having an EAS tag through the exit, an alarm sounds and the management of the store is immediately notified.

One drawback to such a system is that an EAS tag must be placed on each article in the store to protect the article from theft. Although such systems are manageable for stores that sell articles such as videocassettes, compact discs, audio cassettes, and other boxed materials where an EAS tag can be hidden in a place where it cannot be removed, such systems are impracticable for retail stores that sell items having packaging that does not provide a readily available space for hiding or securing an EAS tag. Although locking straps have been developed that wrap about a portion of an article to secure an EAS tag to the article, such EAS tag-carrying straps may be defeated when the article being protected may be easily transferred to another container. Such is the case when the article being protected is wine or liquor.

A retail store selling wine or liquor cannot easily attach an EAS tag to the liquor bottles in a location where it cannot be easily removed by a shoplifter. Further, if an EAS tag-carrying locking strap is utilized, the shoplifter may still open the bottle of liquor and pour the contents into an untagged container and then leave the store. It is thus desired in the art to provide a device that carries an EAS component that may be utilized to prevent the unauthorized opening of a typical wine or liquor bottle. For such a device to be commercially successful, the device must fit a variety of differently sized bottles while being openable with a common key held by the check-out clerk in the retail store. Such devices must also be able to withstand twisting, prying, and shock forces applied to the device by a shoplifter in order to dislodge the device from a bottle.

One example of an anti-theft device for bottles is disclosed in U.S. Pat. No. 5,602,530. The device disclosed in this patent includes an outer socket which can be moved in relation to an inner socket between two end positions with one of the end positions being a locking position. A plurality of retainers are distributed about the periphery of the inner surface of the outer socket. The retainers extend into the inner socket when the outer socket is in the locked end position. These retainers engage the bottle beneath the bead that is typically disposed on the neck of a bottle. The retainers thus prevent the removal of the device from the neck of the bottle until biased outwardly by a magnetic key. Although devices such as this function for their intended purpose, room for improvement remains in the art.

Another example of an anti-theft device for bottles is disclosed in International Publication No. WO99/67149 published on Dec. 29, 1999. This publication discloses a device having an inner member and an outer member in which a locking mechanism comprises teeth extending outwardly from the inner member which lockably engage teeth extending inwardly from arms which extend upwardly from the lower portion of and on the interior of the outer member. The locking mechanism thus lies between respective side walls of the inner and outer members.

BRIEF SUMMARY OF THE INVENTION

The present invention provides a bottle security device for use with a bottle having a neck, the bottle security device comprising an outer member defining a cavity and having a sidewall with an inner surface; an inner member which is movable between locked and unlocked positions; wherein the inner member includes a plurality of locking fingers adapted to fit around at least a portion of the neck and lockably engage the neck when the inner member is in the locked position; wherein a portion of the inner member is disposed in the outer member cavity; and a plurality of strengthening fingers extending upwardly inside the outer member cavity and abutting the inner surface of the outer member sidewall.

The present invention also provides a bottle security device for use with a bottle having a neck, the bottle security device comprising an outer member defining a cavity and having a sidewall with an inner surface; an inner member which is movable between locked and unlocked positions; wherein the inner member is adapted to fit around at least a portion of the neck and lockably engage the neck when the inner member is in the locked position; wherein a portion of the inner member is disposed in the outer member cavity; and a plurality of engaging members disposed inside the outer member cavity and selectively lockably engaging the inner member to lock the inner member in the locked position; and a plurality of strengthening fingers extending upwardly inside the outer member cavity and abutting the inner surface of the outer member sidewall.

BRIEF DESCRIPTION OF THE SEVERAL VIEWS OF THE DRAWINGS

Preferred embodiments of the invention, illustrative of the best mode in which the applicants have contemplated applying the principles of the invention, are set forth in the following description and are shown in the drawings and are particularly and distinctly pointed out and set forth in the appended claims.

Similar numerals refer to similar parts throughout the specification.

DETAILED DESCRIPTION OF THE INVENTION

Figures 1, 2:
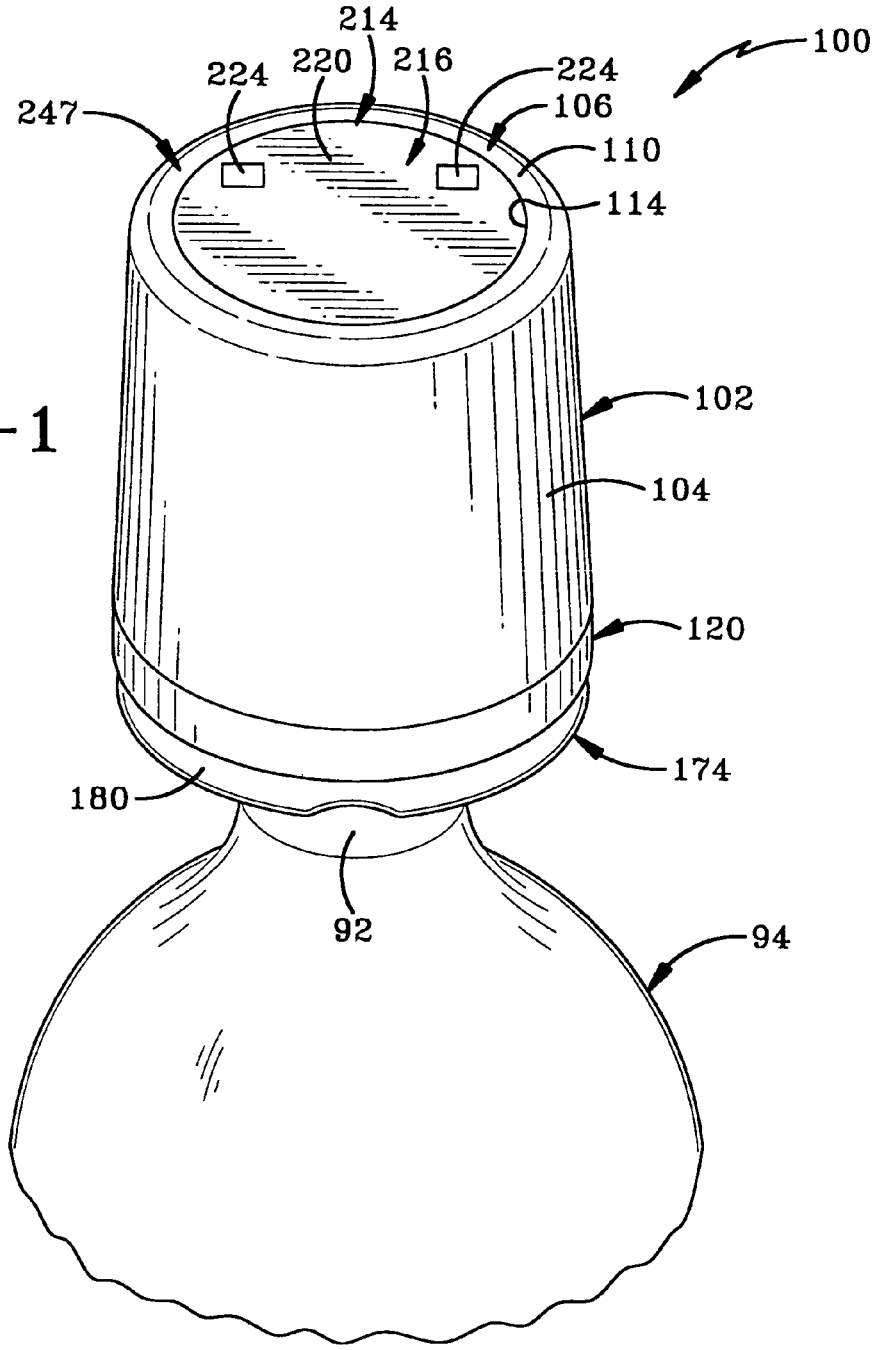
FIG. 1 is a perspective view of the bottle security device of the present invention in a locked position on a bottle.
FIG. 2 is schematic view showing the relative positions of FIGS. 2A and 2B, which together show an exploded view of the entire bottle security device of FIG. 1.

A bottle security device is indicated generally at 100 and is shown in FIGS. 1-19. Bottle security device 100 generally includes an outer member 102, an intermediate member 120, an inner member 146, and a cover assembly 182 including a cover base 184 and a cover cap 214. Device 100 may also include a lower ring member 174. Device 100 includes a locking mechanism that cooperates to lock device 100 on the neck 92 of a typical bottle 94 and an unlocking mechanism that releases the locking mechanism so that device 100 may be unlocked and removed from bottle neck 92. In the exemplary embodiment, the unlocking mechanism may be locked in a locked position with pistons 246 that move between an extended locked position and a retracted unlocked position. Pistons 246 are biased by springs 248 into the locked position and pulled by a magnetic key 256 into the unlocked position. In an alternative embodiment, the unlocking mechanism may be mechanically actuated, such as the locking mechanism 100 disclosed in U.S. Pat. No. 6,125,668, incorporated herein by reference. Bottle security device 100 may be locked on bottle neck 92 until unlocked with a key 256. Inner member 146 moves between locked and unlocked positions which correspond to locked and unlocked positions of device 100.

Figure 3:
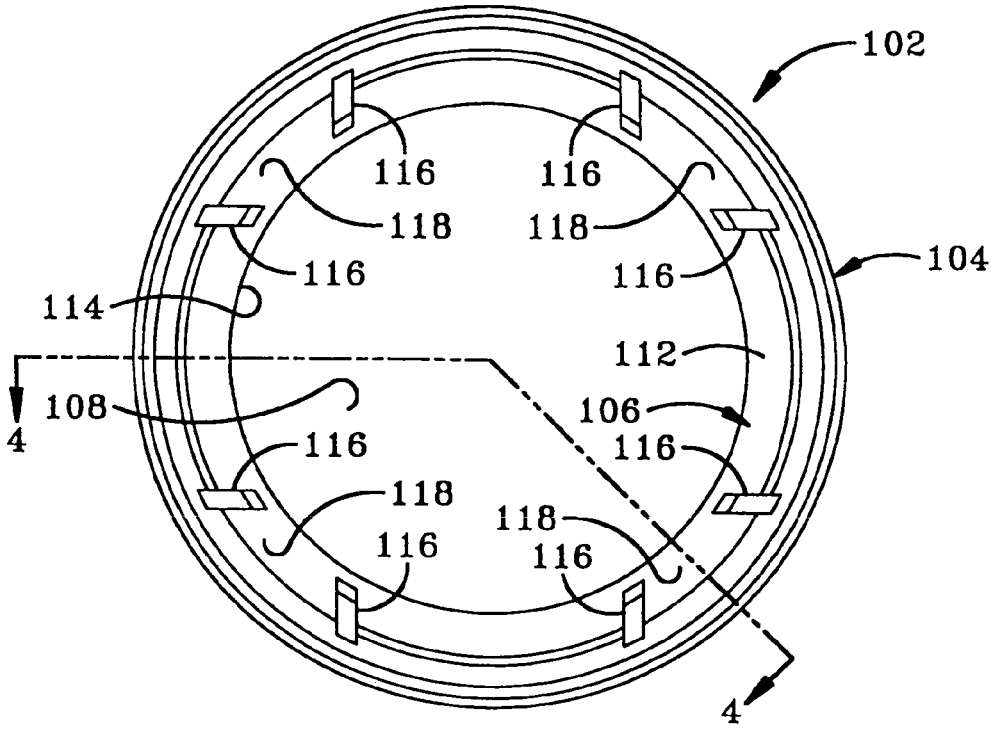
FIG. 3 is a bottom plan view of the outer member of the security device of FIG. 2.
Figure 4:
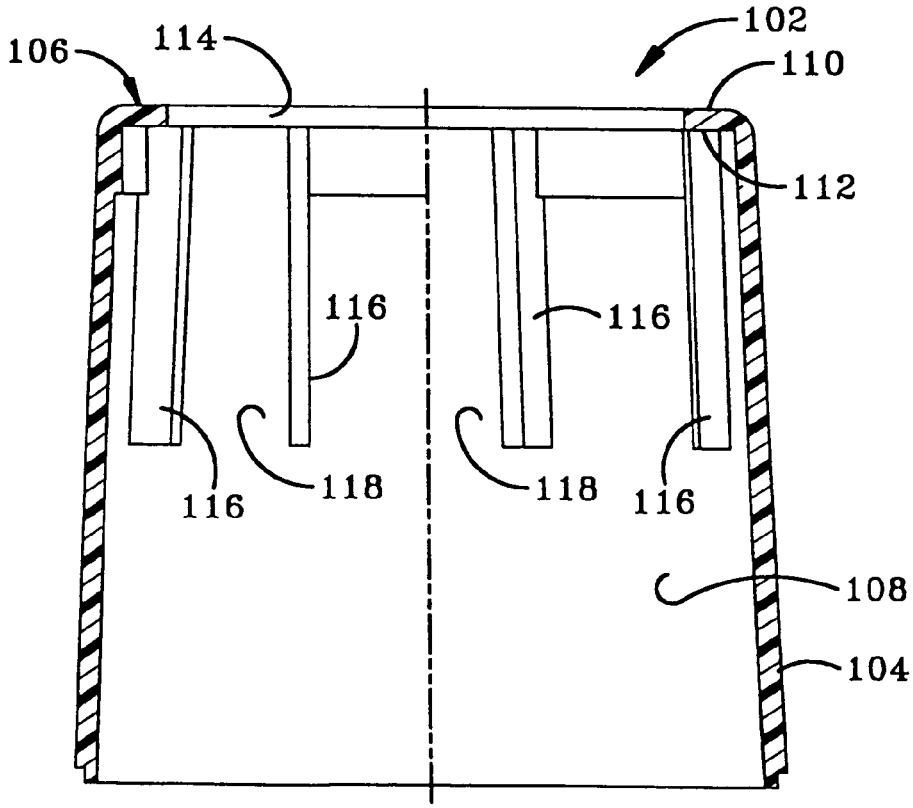
FIG. 4 is a sectional view taken along line 4-4 of FIG. 3.
Figure 5:
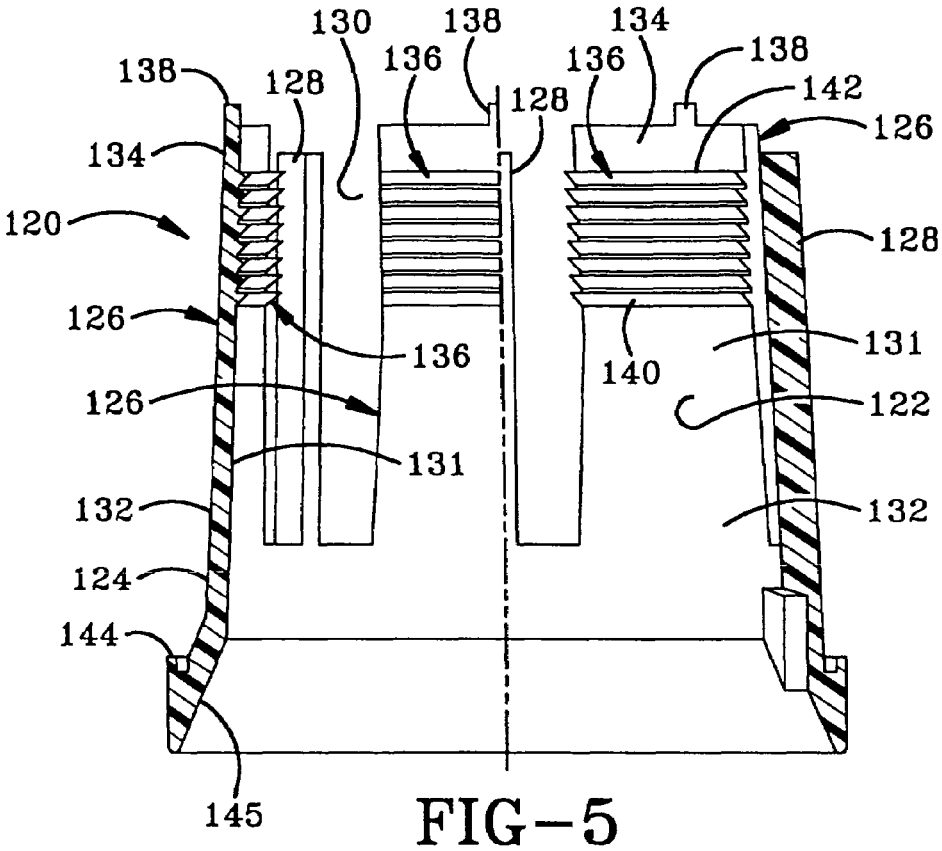
FIG. 5 is a sectional view from a perspective similar to FIG. 4 of the intermediate member of the security device of FIG. 2.
Figure 6:
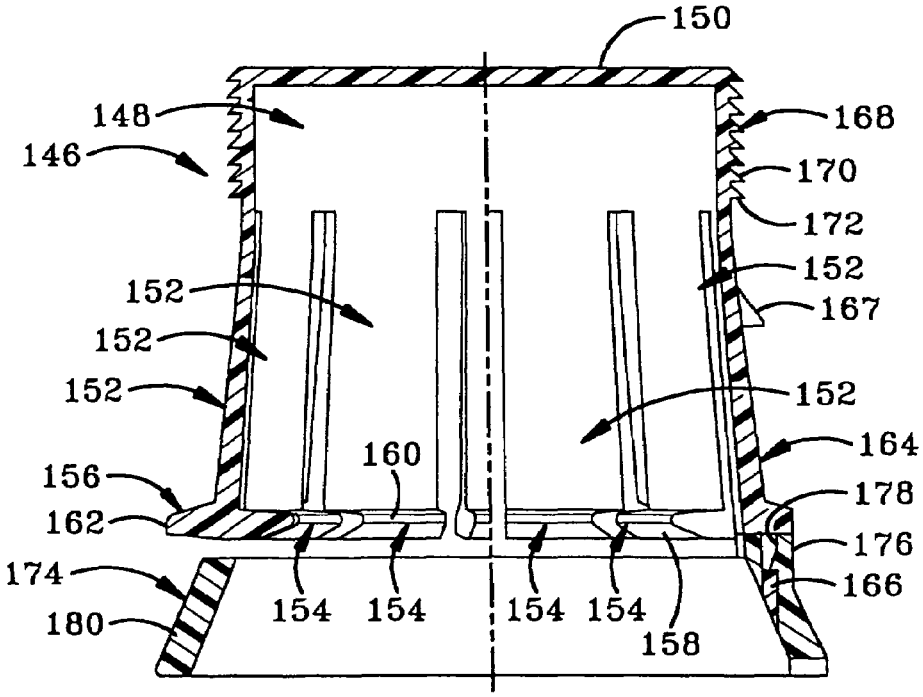
FIG. 6 is a sectional view of the inner member and the lower ring member from a perspective similar to FIG. 4 of the security device of FIG. 2.
Figure 7:
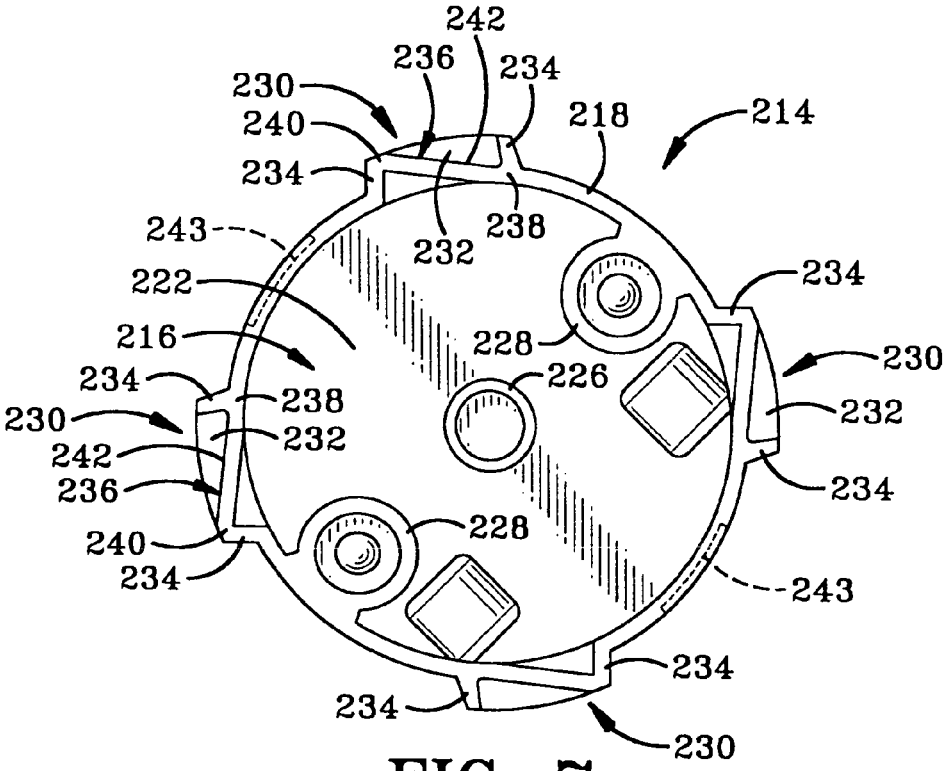
FIG. 7 is a bottom plan view of the cover cap of the security device of FIG. 2.

Outer member 102 (FIGS. 1, 2A, 3 and 4) has a frustoconical sidewall 104 having an inner surface and an annular top wall 106 connected to sidewall 104. Outer member 102 defines a cavity 108 within sidewall 104 and is generally configured to fit over and substantially enclose intermediate member 120 in cavity 108 such that intermediate member 120 may not be readily viewed or accessed from outside bottle security device 100. Top wall 106 has an upper surface 110 and a lower surface 112 and defines a circular entrance opening 114. Cavity 108 extends upwardly to, but not beyond, upper surface 110 of top wall 106. A plurality of parallel ribs 116 extend axially downwardly from lower surface 112 of top wall 106 and inwardly from sidewall 104, extending about half way down sidewall 104. Ribs 116 are situated in adjacent pairs with each pair of ribs 116 angling toward one another to form wedge-shaped channels 118 therebetween, as shown in FIGS. 3 and 4.

Figure 2A:
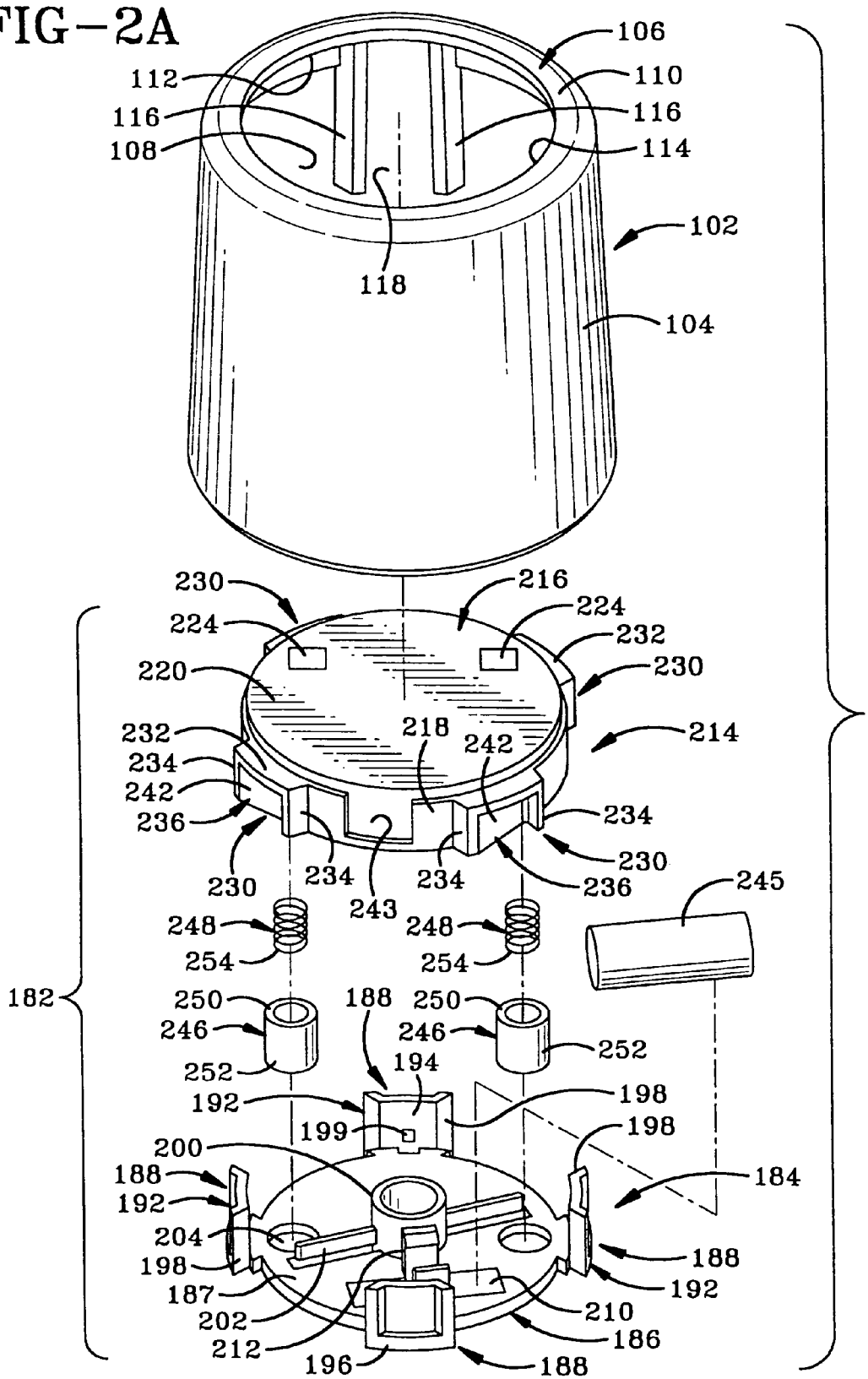
FIG. 2A is an exploded view of part of the bottle security device of FIG. 1, including the outer member, the cover cap, the cover base, pistons, springs and EAS tag.
Figure 2B:
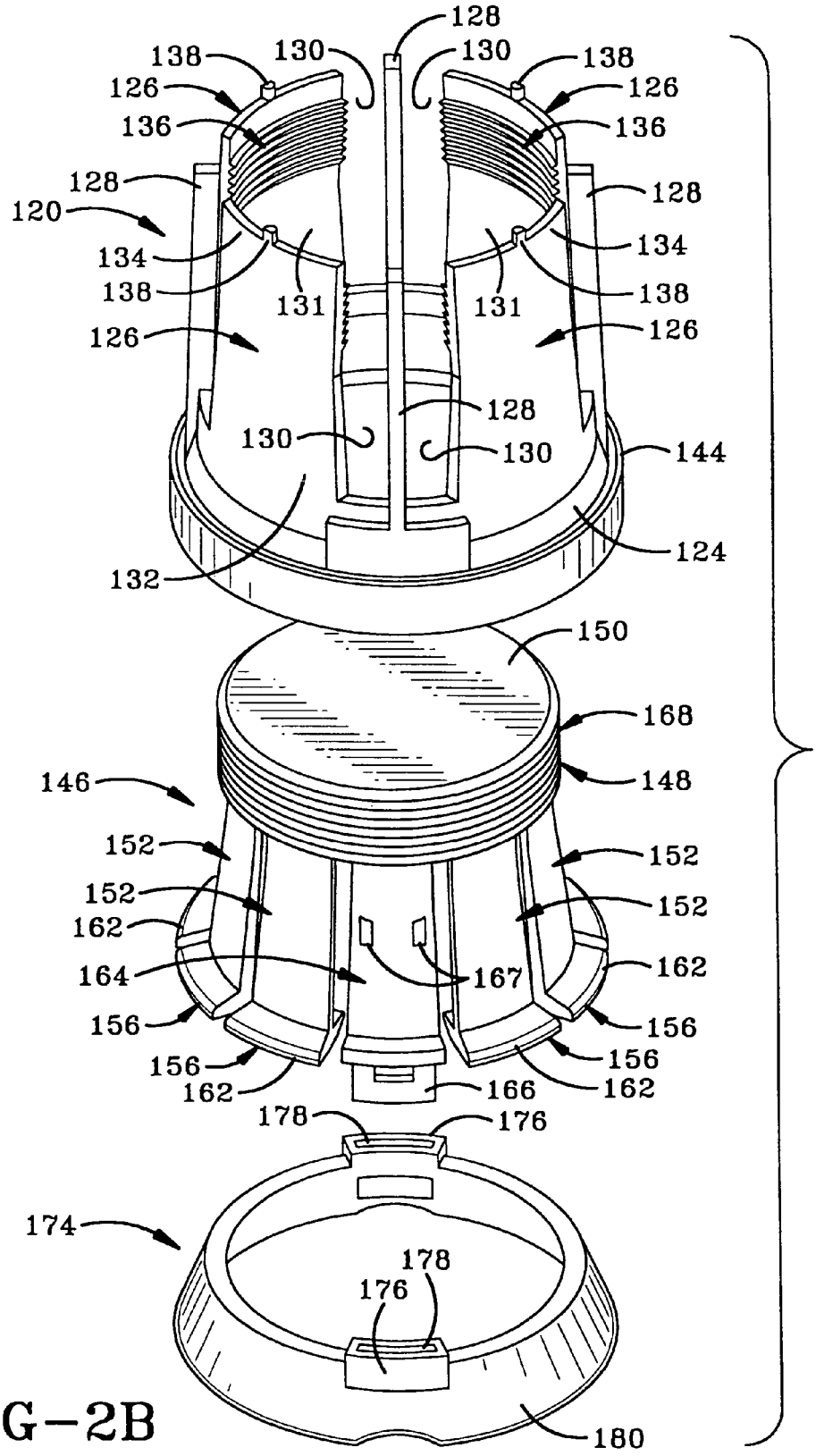
FIG. 2B is an exploded view of part of the bottle security device of FIG. 1, including the intermediate member, the inner member and the ring member.

Intermediate member 120 (FIGS. 2B and 5) is generally frustoconical, defines an internal cavity 122 and is generally configured to fit over and substantially enclose inner member 146 in cavity 122 such that inner member 146 may not be readily viewed or accessed from outside bottle security device 100. Intermediate member 120 includes an annular sidewall or body 124 with a plurality of broad engaging fingers 126 cantilevered upwardly from sidewall 124 and, in accordance with one of the main features of the invention, a plurality of narrow strengthening or seat fingers 128 cantilevered upwardly from sidewall 124. Engaging fingers 126 and seat fingers 128 alternate so that each engaging finger 126 is disposed between an adjacent pair of seat fingers 128 and each seat finger 128 is disposed between a pair of adjacent engaging fingers 126. Each seat finger 128 is spaced from a respective pair of engaging fingers 126 by a respective pair of slots 130. Each strengthening or seat finger 128 lies closely adjacent or abuts the inner surface of outer member sidewall 104, the latter configuration shown in FIG. 9, to add structural strength to device 100, as further detailed below. Each engaging finger 126 has an inner surface 131, a first end 132 connected to sidewall 124 and a second end 134. Each engaging finger 126 includes a plurality of inwardly facing arcuate teeth 136 disposed distal sidewall 124 and a cam follower 138 extending upwardly from second end 134. Each tooth 136 includes an angled portion 140 and a locking portion 142 that is substantially normal to the inner surface 131 of engaging fingers 126. Sidewall 124 includes a ledge 144 configured to mate with the lower end of sidewall 104 of outer member 102 whereby intermediate member 120 is fixedly attached to outer member 102 by snap-fit engagement, ultrasonic welding, glue or any other suitable means known in the art. The interior of sidewall 124 includes a camming surface 145 which tapers radially inwardly and upwardly.

Figure 10:
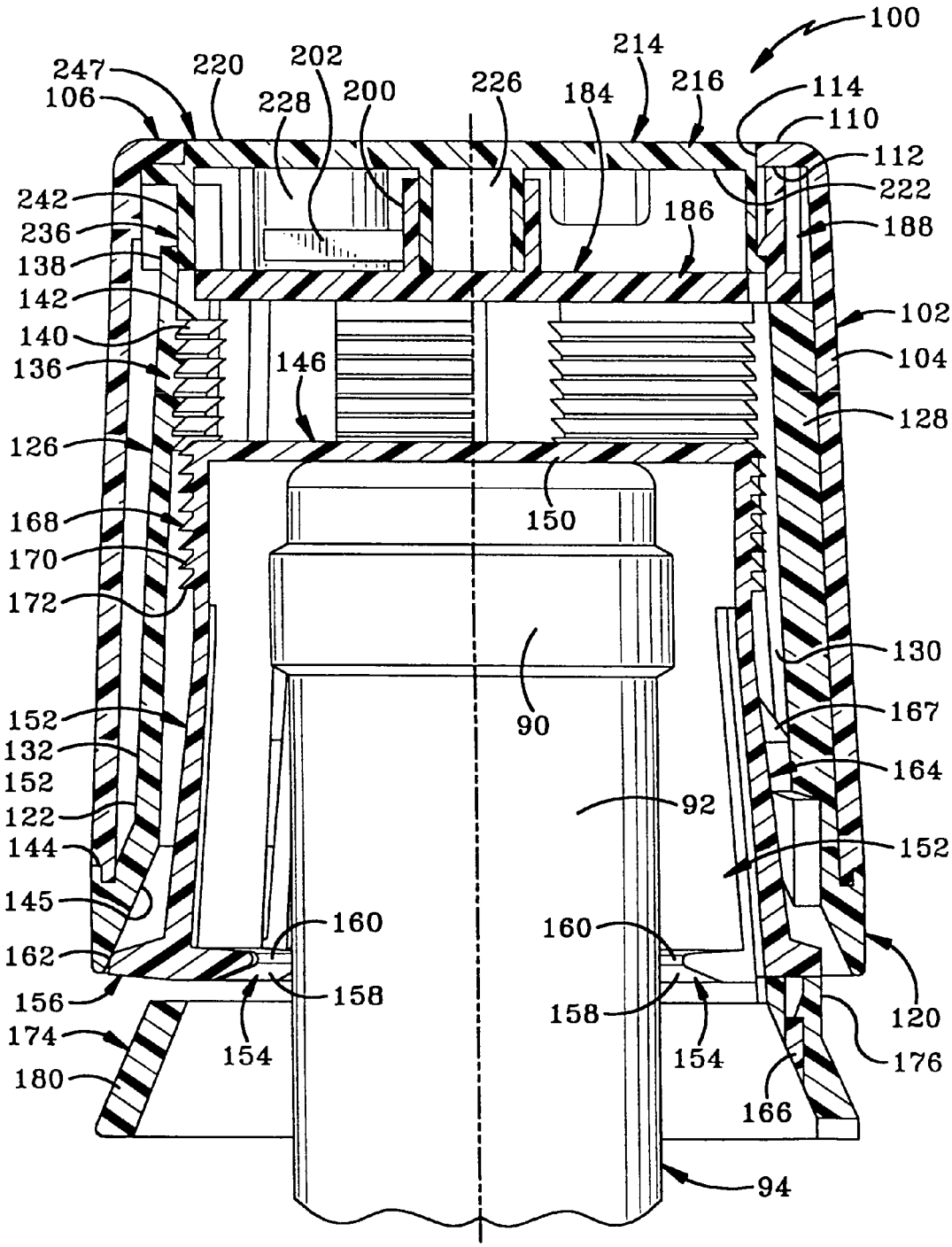
FIG. 10 is a view similar to FIG. 9 with the neck of a bottle positioned in the cavity of the inner member.
Figure 11:
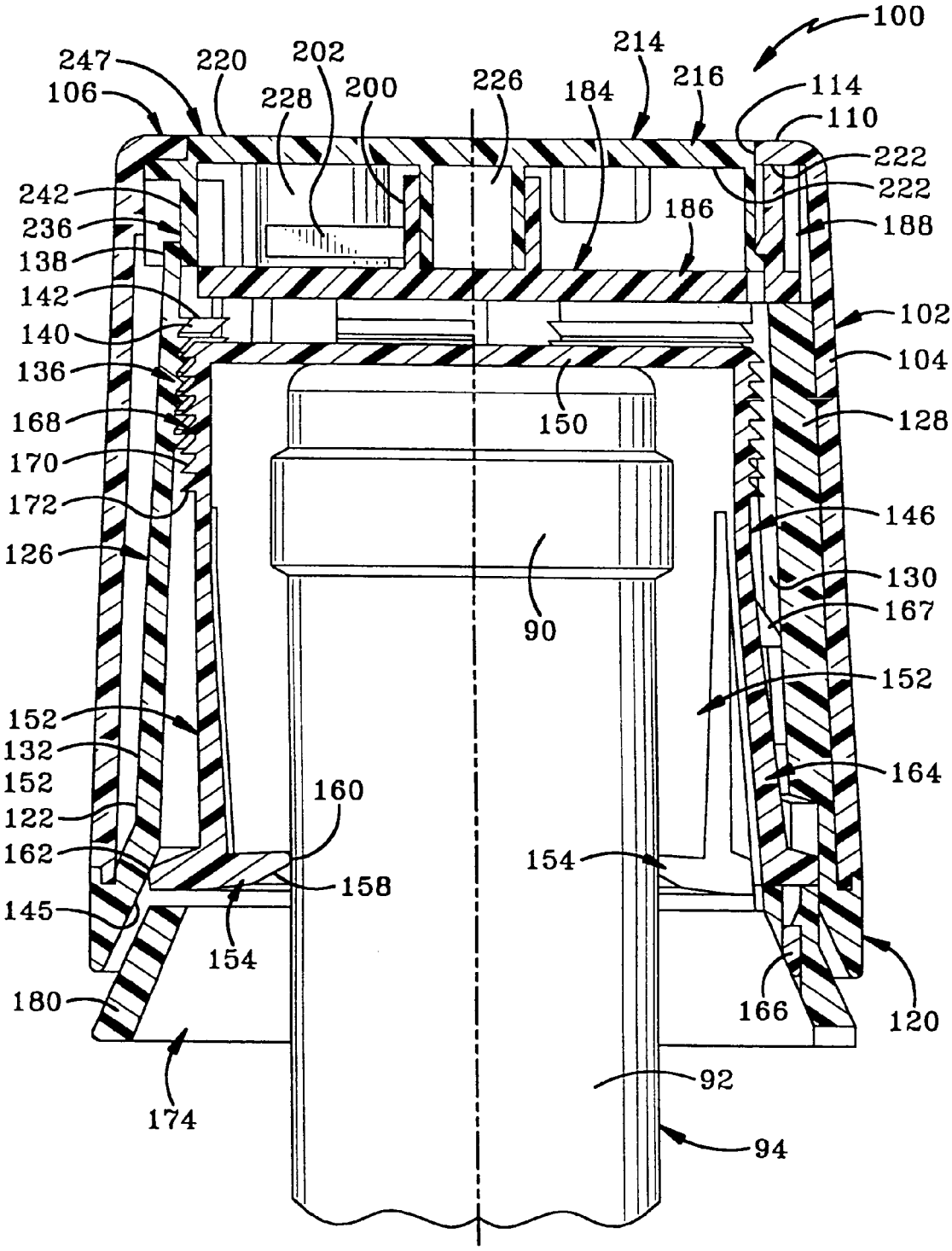
FIG. 11 is a view similar to FIG. 10 but in a locked position.
Figure 12:
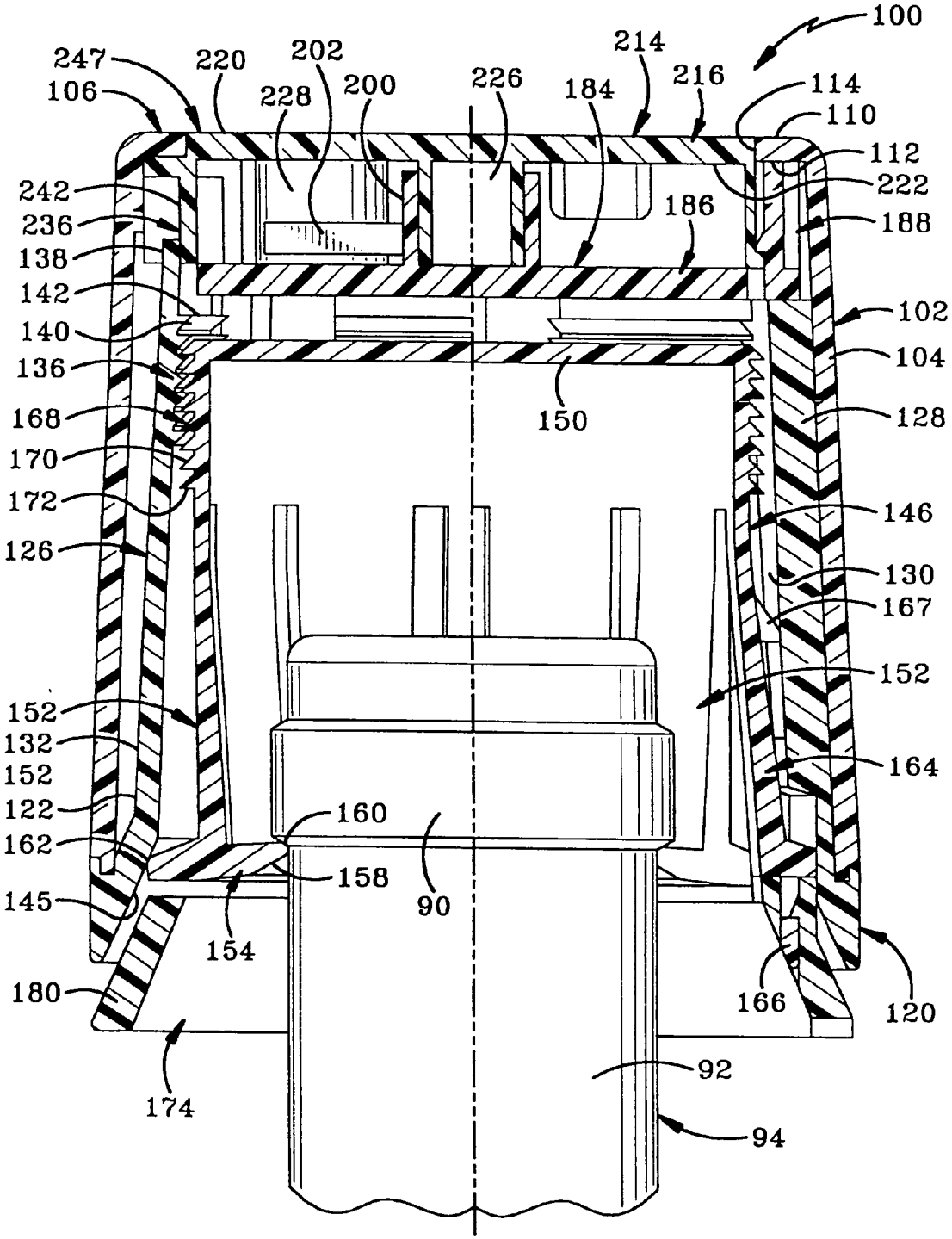
FIG. 12 is a view similar to FIG. 11 but showing the locking fingers of the inner member engaging the bead of the bottle neck to prevent an attempted removal of the bottle neck from the device.

Inner member 146 (FIGS. 2B and 6) includes an annular sidewall 148 and a circular top wall 150 connected thereto. Inner member 146 further includes a plurality of locking fingers 152 cantilevered downwardly from sidewall 148, each locking finger 152 having disposed distal sidewall 148 an inwardly extending inner shoulder 154 and an outwardly extending outer shoulder 156. Locking fingers 152 are configured to fit over a bead 90 (FIG. 10) typically disposed on a neck 92 of a bottle 94. Locking fingers 152 may be sized to engage bead 90 and be forced radially outwardly when inner member 146 is forced over bead 90. To facilitate such movement, each inner shoulder 154 is provided with an angled or arcuate surface 158 configured to engage the upper surface of bead 90 when inner member 146 is forced over bead 90. Locking fingers 152 are further configured to be resilient so that they return to their resting position after being forced over bead 90. In such a resting position, as depicted in FIG. 10, inner surfaces 160 of inner shoulder 154 may or may not contact bottle neck 92 depending on its size. Each inner shoulder 154 is disposed below bead 90 once inner member 146 is placed on bottle neck 92. Each outer shoulder 156 has an outer surface 162 configured to cooperate with camming surface 145 on intermediate member 120 to urge locking fingers 152 inwardly against bottle neck 92 when security device 100 is moved from the unlocked position (FIG. 10) to the locked position (FIGS. 11-12).

Inner member 146 further includes a pair of diametrically opposed connecting fingers 164 cantilevered downwardly from sidewall 148 with a connecting tab 166 extending downwardly from each connecting finger 164. A pair of retaining tabs 167 extend outwardly from each connecting finger 164 and are slidably received in slots 130 of intermediate member 120 to prevent inner member 146 from sliding out of inner member 146 when in the unlocked position.

Sidewall 148 of inner member 146 includes a plurality of radially outwardly extending annular teeth 168. Each tooth 168 includes an upwardly facing angled portion 170 and a locking portion 172 that is disposed substantially normal to the outer surface of sidewall 148. Teeth 168 are disposed over a substantial longitudinal portion of sidewall 148. Teeth 168 may also extend down onto fingers as needed. Teeth 168 are configured to lockingly engage teeth 136 of engaging fingers 126 of intermediate member 120 to retain inner member 146 sufficiently within intermediate member 120 to keep locking fingers 152 of inner member 146 in the locked position. It will be appreciated that teeth 168 and teeth 136 may have a variety of configurations without departing from the spirit of the invention as long as they engage one another sufficiently to retain inner member 146 in the locked position as described.

Lower ring member 174 (FIGS. 2B and 6) is generally frustoconical and includes a pair of diametrically opposed receptacles 176 defining arcuate apertures 178 for slidably receiving respective connecting tabs 166 of inner member 146 in a snap-fit engagement to connect ring member 174 to inner member 146 adjacent the lower end of inner member 146. Ring member 174 may be connected to inner member by other suitable means as noted above. Ring member 174 is disposed below locking fingers 152 so as to surround a portion of bottle neck 92 when device 100 is installed thereon. Ring member 174 has a tapered outer surface 180 which angles upwardly and inwardly on an incline complementary to the taper of camming surface 145 of intermediate member 120, which facilitates ring member 174 abutting with intermediate member 120 to help prevent tampering, as further described below. When connected with intermediate member 120, ring member 174 also provides additional stability and rigidity thereto and provides a structure which can be easily pushed by hand to move inner member 146 into the locked position within cavity 122 of intermediate member 120 without engaging top wall 150 of inner member 146 with the top of bottle neck 92.

Figure 8:
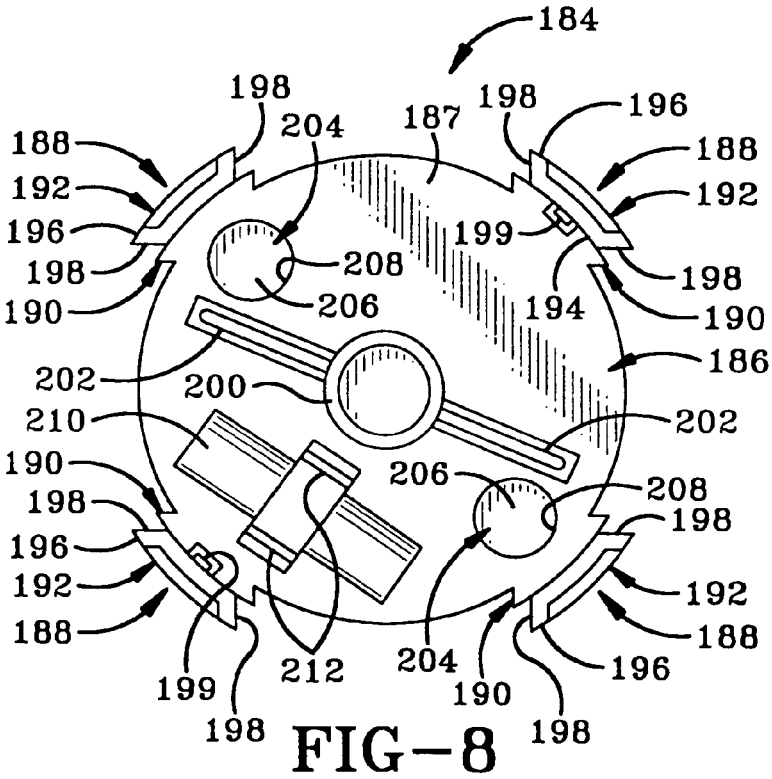
FIG. 8 a top plan view of the cover base of the security device of FIG. 2.

Cover base 184 (FIGS. 2A and 8) includes a substantially flat circular wall 186 having a generally flat upper surface 187. Cover base 184 further includes a plurality of tabs 188 connected to the perimeter of circular wall 186. Each tab 188 has a first portion 190 extending radially outwardly and a second portion 192 extending axially upwardly from first portion 190. Second portion 192 has an inner surface 194 and an outer surface 196 and sides 198 which taper outwardly from inner surface 194 to outer surface 196. Tabs 188 are thus wedge-shaped when viewed from above as shown in FIG. 8. A pair of protuberances 199 extend inwardly from inner surface 194 of second portion 192. Tapered sides 198 of each tab 188 are complementary to and slidingly receivable by respective wedge-shaped channels 118 of outer member 102 to align cover base 184 and prevent it from rotating within outer member 102.

A hollow cylinder 200 extends upwardly from the center of wall 186 and a pair of diametrically opposed arm springs 202 extend radially outwardly from cylinder 200. A pair of diametrically opposed cylindrical locking depressions 204 are formed in wall 186, each depression 204 situated adjacent a respective tab 188 and a respective spring arm 202. Each locking depression 204 is bounded by a circular floor 206 and a cylindrical sidewall 208 extending upwardly therefrom. An elongated tag-receiving indentation 210 is formed in wall 186 with a pair of spaced retaining arms 212 extending upwardly from wall 186 on opposite sides of indentation 210.

Cover cap or rotatable member 214 (FIGS. 2A and 7) includes a substantially flat or slightly concave circular top wall 216 and a substantially cylindrical sidewall 218 connected to the perimeter of top wall 216. Top wall 216 has an upper surface 220 and a lower surface 222. A pair of key alignment holes 224 (FIG. 1) extend downwardly from upper surface 220. A hollow alignment cylinder 226 extends centrally downwardly from lower surface 222 of top wall 216. A pair of diametrically opposed hollow cylindrical housings 228 extend downwardly from top wall 216 adjacent sidewall 218. A plurality of camming arms 230 extend outwardly from sidewall 218. Each camming arm 230 includes a top wall 232 stepped down from top wall 216 of cover cap 214, a pair of sidewalls 234 extending downwardly from top wall 232 of camming arm 230 and outwardly from sidewall 218 of cover cap 214, and an angled camming wall 236 tapering outwardly from an inner end 238 of one camming arm sidewall 234 to an outer end 240 of the other camming arm side wall 234. Each camming wall 236 has an outwardly facing camming surface 242 which slidingly engages a respective cam follower 138 of a respective engaging finger 126 of intermediate member 120 to move engaging finger 126 outwardly and inwardly as cover cap 214 is rotated. A pair of elongated connecting depressions 243 are formed in sidewall 218 and receive respective protuberances 199 of cover base 184 in a snap fit engagement.

Cover cap or rotatable member 214 is rotatably disposed atop cover base 184 (FIG. 14) to form an enclosure 244 therebetween. Cover cap 214 and cover base 184 are held together by the snap fit engagement of protuberances 199 in depressions 243. Protuberances 199 are laterally slidable in depressions 243 to allow cover cap 214 to rotate with respect to cover base 184. While depressions and tabs are not necessary to the function of device 100, they help prevent pistons 246 and springs 248 from falling out during the assembly of device 100. An electronic article surveillance (EAS) tag 245 (FIG. 2A) is disposed within enclosure 244 and is seated in tag-receiving indentation 210 and held in place by retaining arms 212 by a snap-fit engagement. Any of a variety of tags 245 may be used with device 100 and the coil depicted in the drawings is but one example. Alignment cylinder 226 is inserted in cylinder 200 allowing cap 214 and base 184 to rotate with respect to one another. Cover assembly 182 is disposed in cavity 108 of outer member 102 so that top wall 216 of cover cap 214 is slidingly received in circular entrance opening 114 of outer member 102 and top walls 232 of respective camming arms 230 lie closely adjacent or abut lower surface 112 of outer member top wall 106. Top wall 216 has a diameter slightly smaller than the diameter of entrance opening 114 so that the perimeter of top wall 216 lies closely adjacent the perimeter of entrance opening 114. This configurations allows top wall 216 to rotate within entrance opening 114 while helping prevent tampering with device 100 by reducing the ability to insert a pry bar or the like between cover cap top wall 216 and outer member top wall 106. Top wall 216 of cover cap 214 and top wall 106 of outer member 102 together form a top wall 247 of security device 100. Upper surface 220 of cover cap top wall 216 is substantially continuous with upper surface 110 of outer member top wall 106 except for the small annular space between the two in the exemplary embodiment, upper surface 110 is disposed at approximately the same level as upper surface 220. Cover cap top wall 216 may alternatively be disposed below or project slightly above upper surface 110 of outer member top wall 106.

Figure 9:
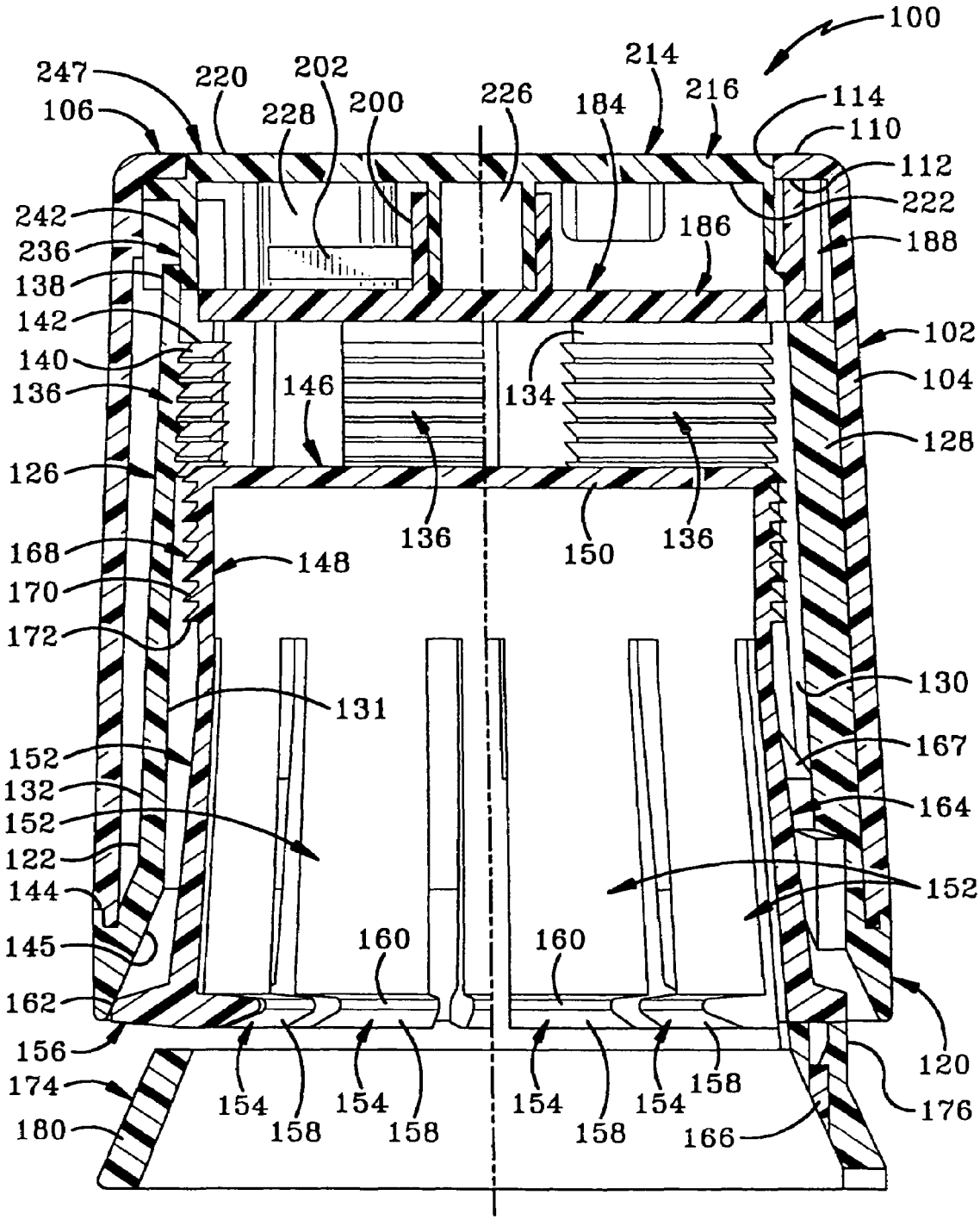
FIG. 9 is a sectional view from a perspective similar to FIG. 4 of the bottle security device of FIG. 2 in an unlocked position.

Tabs 188 of cover base 184 are seated on seat fingers 128 of intermediate member 120 to vertically position cover base 184 (FIG. 9). Tabs 188 of cover base 184 act as stops for camming arms 230 of cover cap 214 as cover cap is rotated, as further described below, in the direction of arrows $\alpha$ shown in FIG. 17 to prevent damage to spring arms 202 and dislocation of EAS tag 245.

In accordance with one of the main features of the invention, a rotatable unlocking mechanism is associated with cover assembly 182 and functions to unlock device 100. Cover assembly 182 includes a locking mechanism disposed within enclosure 244 to prevent or allow the rotation of cover cap 214. The rotation of cover cap 214 is essential in the function of the unlocking mechanism, which is disposed outside enclosure 244 about the perimeter of cover assembly 182 and is further described below.

Figure 13:
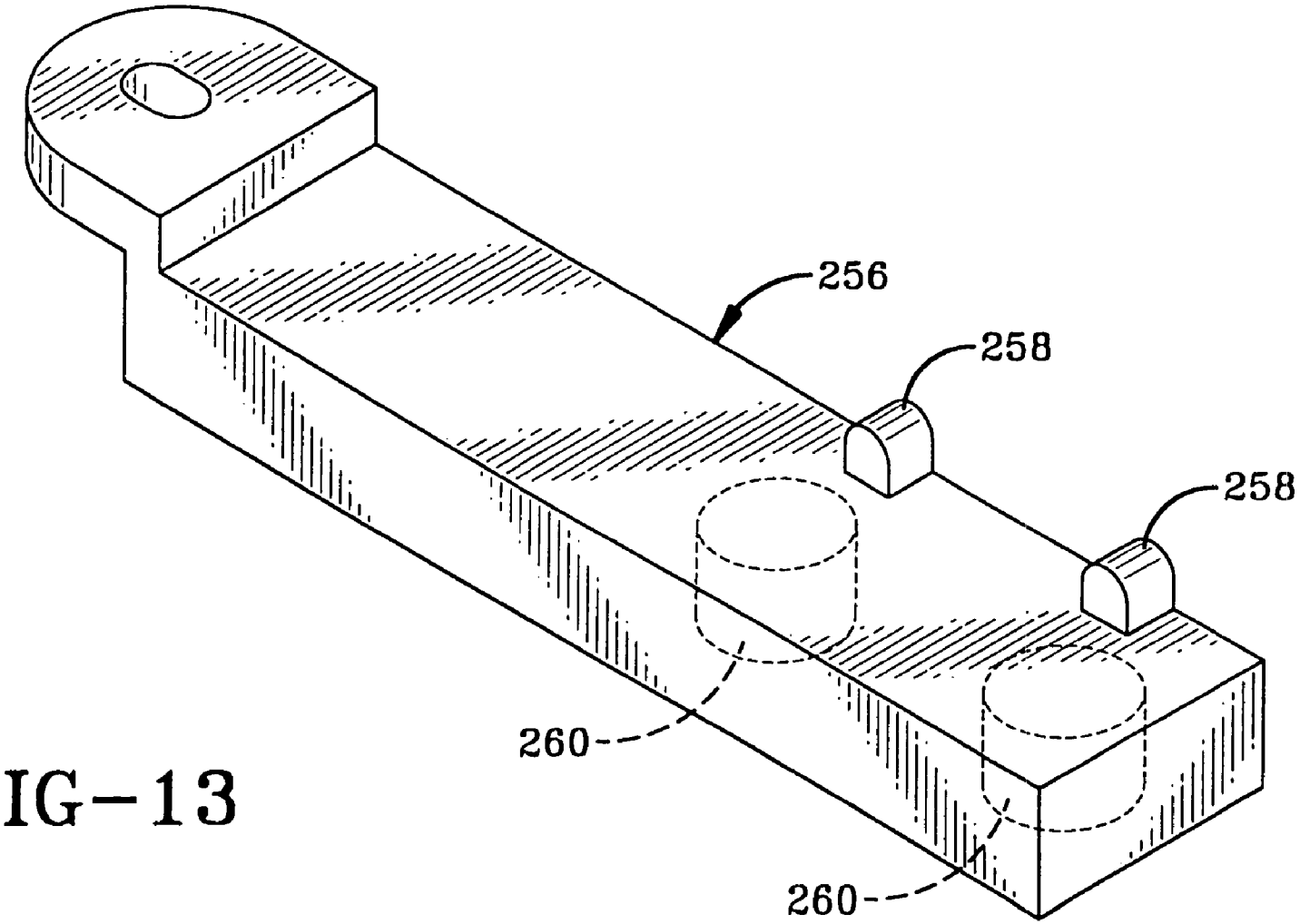
FIG. 13 is a perspective view of a key for use with the security device of FIG. 2.
Figure 14:
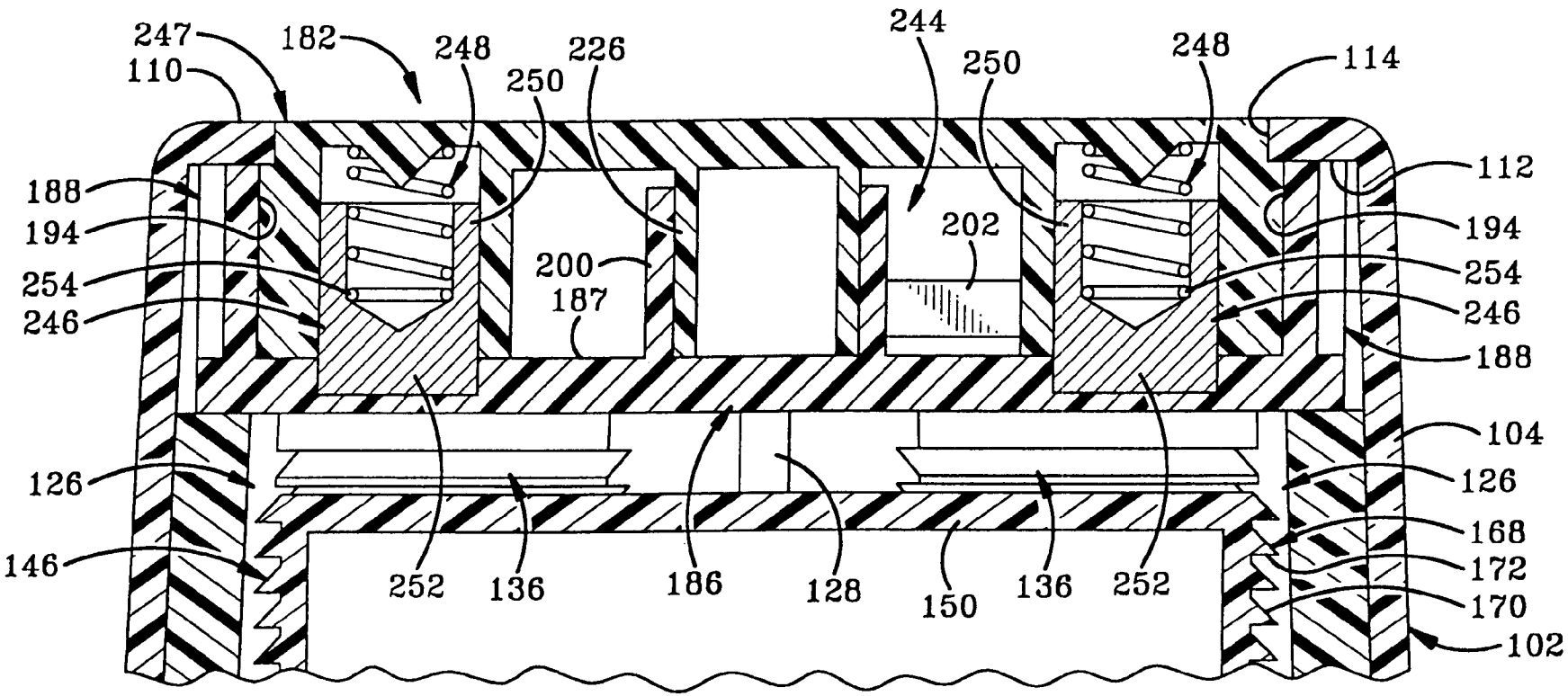
FIG. 14 is a fragmentary sectional view of the bottle security device showing the cover assembly in a locked position.
Figure 15:
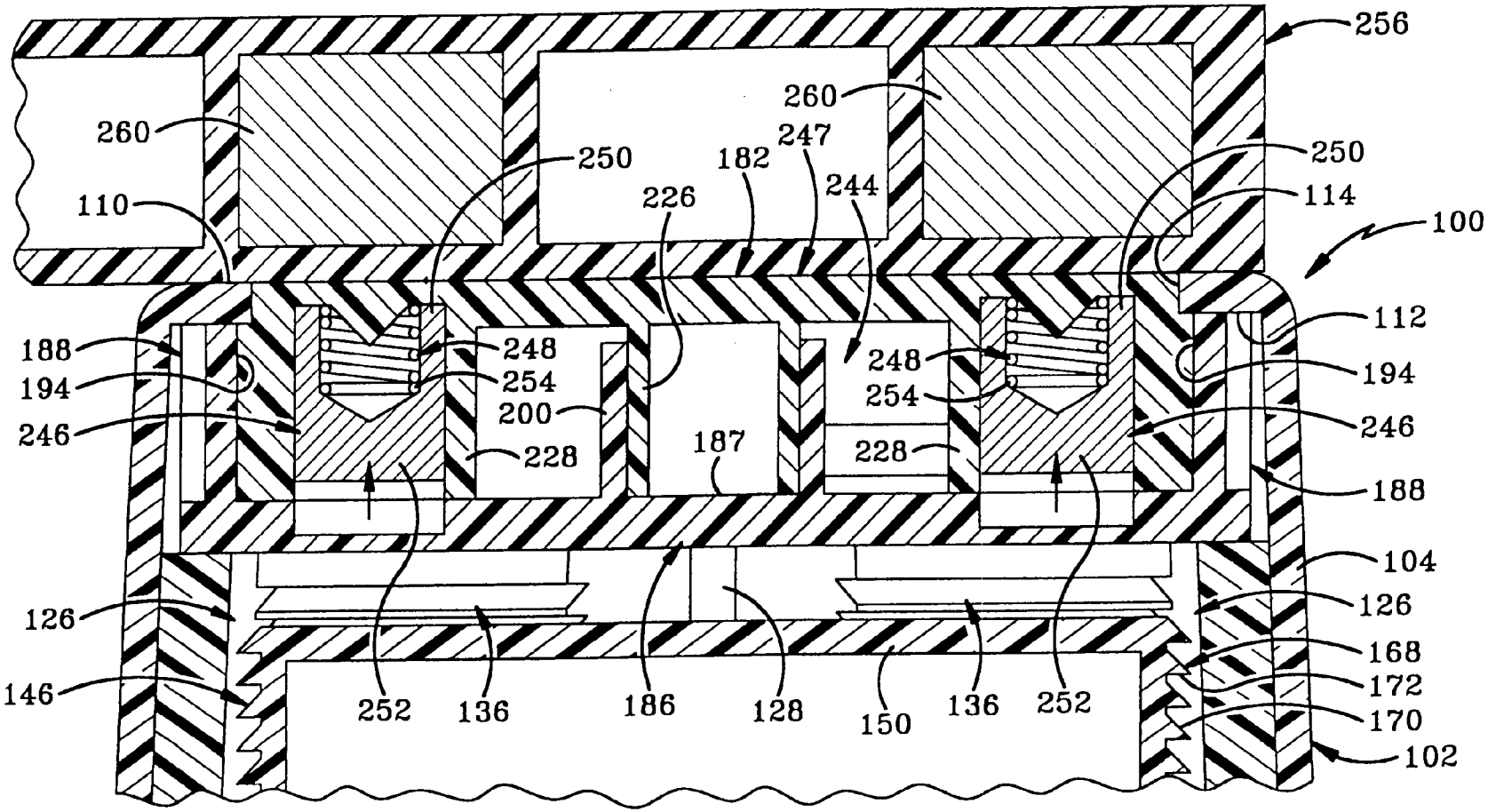
FIG. 15 is a view similar to FIG. 14 but showing the key atop the cover assembly with the cover assembly in an unlocked position.
Figure 16:
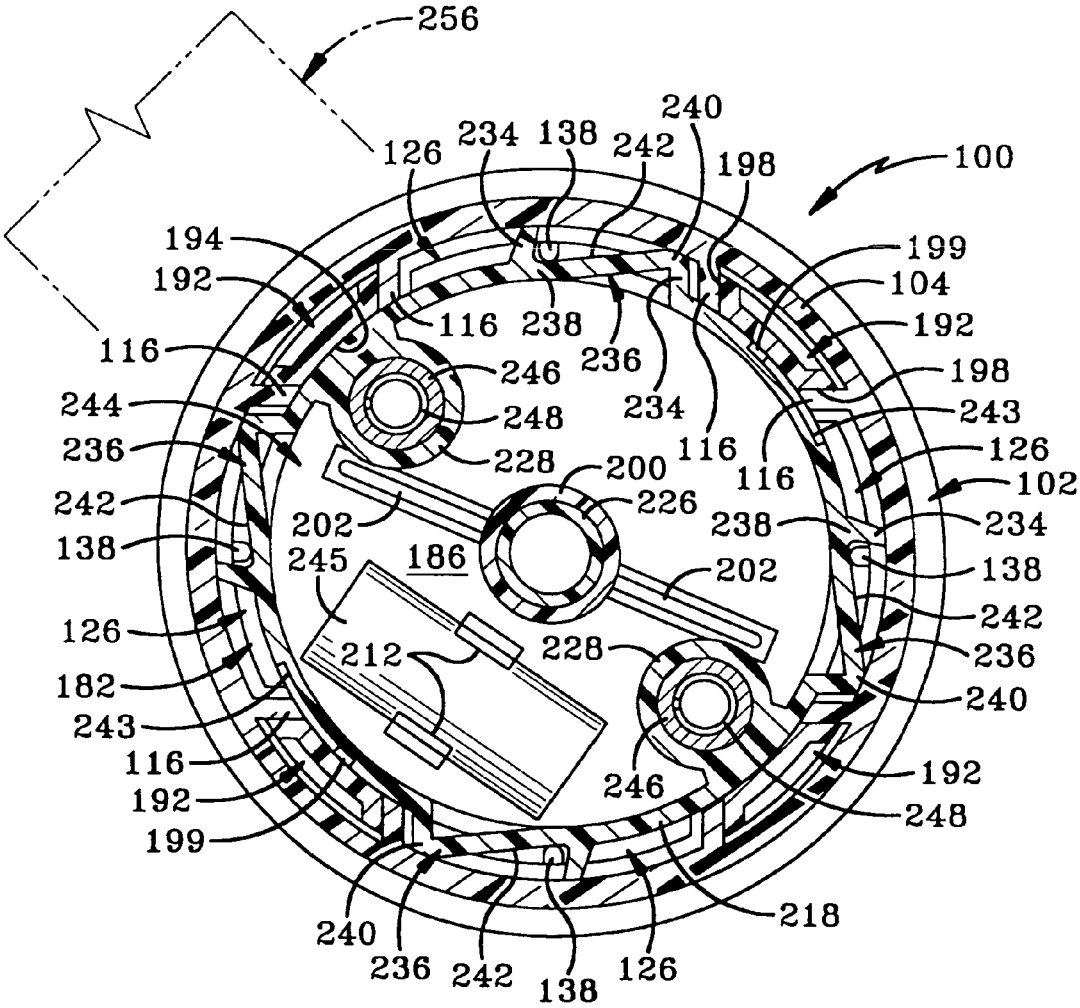
FIG. 16 is a sectional view from above the cover assembly showing the cover cap in a non-rotated position with the key shown in phantom atop the cover assembly.

The cover assembly 182 locking mechanism includes a pair of cylindrical pistons 246 and a pair of corresponding coil springs 248 all of which are generally disposed within respective housings 228 of cover cap 214 (FIGS. 14-15). Each piston 246 has a hollow portion 250 and a solid portion 252, hollow portion 250 opening upwardly and receiving a lower end 254 of a respective spring 248 and solid portion 252 extending into locking depressions 204 of cover base 184 when not magnetically retracted upwardly by a magnetic key 256 (FIG. 13). Cover assembly 182 is in a locked position (FIG. 14) when pistons 146 extend into depressions 204 so that an interference is created between pistons 146 and respective sidewalls 208 bounding depressions 204 so as to prevent rotation of cover cap 214. Cover assembly 182 is in an unlocked position (FIG. 15) when pistons 146 are withdrawn from depressions 202 so as to allow rotation of cover cap 214. A similar locking mechanism may be configured so that a piston creates interference between cover cap 214 and outer member sidewall 104 to prevent rotation of cover cap 214.

The unlocking mechanism includes camming surfaces 242 of respective camming arms 230 and cam followers 138 of respective engaging fingers 126. As further described below, rotation of cover cap 214 makes cam followers 138 ride on camming surfaces 242 to disengage engaging fingers 126 from inner member 146 to unlock device 100. Magnetic key 256 (FIG. 13) includes alignment tabs 258 which fit into key alignment holes 224 on cover cap 214 to align magnets 260 with pistons 246 and springs 248 (FIG. 15). Alignment tabs 258 may be omitted for the purpose of aligning magnets 260 as noted without departing from the spirit of the invention. However, a means of rotating cover cap 214 is needed, which tabs 258 or another structure serves, as further described below. For this latter purpose, tabs 258 are preferably on key 256, but may be provided separately without departing from the spirit of the invention.

Outer member 102, intermediate member 120, inner member 146, cover base 184, cover cap 214 and ring member 174 may be preferably fabricated from a plastic that is resistant to the typical destructive forces that a prospective shoplifter may inflict on device 100. Members 102, 120, 146, 184, 214 and 174 may, however, be fabricated from other suitable materials in other embodiments of the present invention. In such other embodiments, for instance, different numbers of locking fingers 152, connecting fingers, engaging fingers 126, camming arms 230, spring arms 202, pistons 246 and springs 248 may be used to accomplish the concepts of the present invention. In still other embodiments of the present invention, the overall shapes of outer member 102, intermediate member 120 and inner member 146 may be varied without departing from the concepts of the present invention.

Device 100 is installed by placing inner member 146 on bottle neck 92 of bottle 94. As shown in FIGS. 10 and 11, the top of bottle 94 engages and pushes upward on top wall 150 or the user pushes upwardly on inner member 146 or ring member 174, either action causing outer shoulders 156 to engage and slide along tapered camming surface 145 of intermediate member 120 to cause locking fingers 152 to move inwardly so that inner shoulders 154 of locking fingers 152 are disposed below bead 90 of bottle neck 92 and preferably rest against bottle neck 92. Teeth 168 of inner member 146 engage teeth 136 of intermediate member 120 to retain device 100 in the locked position, thus preventing inner member 146 from being moved outwardly from within cavity 122 of intermediate member 120. Device 100 automatically locks by the simple insertion of inner member 146 into intermediate member 120 to a sufficient extent to sufficiently move locking fingers 152 inwardly and to establish engagement between teeth 168 and 136 as described. The rotatable unlocking mechanism must then be used to unlock device 100 so that it may be removed from bottle 94.

The use of bottle security device 100 with bottle 94 is depicted in cross section in FIGS. 9-12 and 14-19. A first position for device 100 is depicted in cross section in FIG. 9 prior to inserting bottle neck 92 (not shown in FIG. 9) into inner member 146. In the first position, inner member 146 is positioned within intermediate member 120 so that teeth 168 of inner member 146 are disengaged from engaging fingers 126 of intermediate member 120 and locking fingers 152 are extended radially outwardly, and thus device 100 is in the unlocked position.

The next position for device 100 is depicted in cross section in FIG. 10. In this position, inner member 146 has been placed on bottle neck 92 so that inner shoulders 154 of locking fingers 152 are disposed below bead 90. As noted above, locking fingers 152 may be sized to engage bead 90 and be forced radially outwardly when inner member 146 is forced over bead 90. This movement is facilitated by angled or arcuate surface 158 on shoulders 154 engaging the upper surface of bead 90. Once inner member 146 is placed on neck 92, outer member 102 and intermediate member 120 are moved downwardly over inner member 146. In the position depicted in FIG. 10, tapered camming surface 145 is in an initial engagement with outer shoulders 156 of locking fingers 152 and the top of bottle 94 is shown in contact with top wall 150 of inner member 146. Inner member 146 and device 100 thus remain in the unlocked position.

FIG. 11 depicts the locked position of device 100, inner member 146 having moved further into intermediate member 120 so that camming surface 145 urged locking fingers 152 inwardly against neck 92 of bottle 94. Depending on the diameter of neck 92 of bottle 94, inner member 146 in its entirety, including connecting tabs 166, may be disposed within intermediate member cavity 122 in the locked position. In general, locking fingers 152 are entirely disposed within cavity 122 in the locked position even if tabs 166 are not. This extent of insertion of inner member 146 into intermediate member cavity 122 enhances the difficulty of tampering with device 100. The movement of inner member 146 also caused teeth 168 of inner member 146 to engage teeth 136 of engaging finger 126 of intermediate member 120 to retain device 100 in the locked position, thus preventing inner member 146 from being moved outwardly from within cavity 122 of intermediate member 120. More specifically, removal of inner member 146 from intermediate member 120 is prevented due to the engagement of locking portions 142 and 172 of teeth 136 and 168, respectively, since locking portions 142 and 172 cannot slide past one another due to their angles being substantially perpendicular to the direction of force needed to withdraw bottle 94 from inner member 146. The angles of locking portions 142 and 172 may be varied without departing from the spirit of the invention as long as they prevent outward movement of inner member 146 from intermediate member 120 and thus maintain locking fingers 152 in the locked position. In this position, device 100 is locked on bottle neck 92 so that it cannot be removed by a shoplifter.

An attempt to remove device 100 from bottle 94 is depicted in FIG. 12. When such an attempt is made, inner shoulders 154 of inner member 146 engage bead 90 of bottle 94, preventing the further upward movement of device 100 with respect to bottle 94. In the positions depicted in FIGS. 11 and 12, the contents of bottle 100 cannot be removed from bottle 100 without breaking bottle 100. Shoulders 154 and 156 of locking fingers 152 are configured to substantially fill the space between intermediate member 120 and bottle neck 92 such that a prospective shoplifter cannot easily insert a pry bar between intermediate member 120 and inner member 146 to potentially break device 100 away from bottle 94. Intermediate member 120 and outer member 102 are also fabricated from a material that substantially resists such prying forces.

In accordance with another main feature of the invention, strengthening or seat fingers 128 are, as noted above, abut or lie closely adjacent the inner surface of outer member sidewall 104 (FIGS. 9-12) and also are disposed closely adjacent to teeth 168 on inner member sidewall 148. The attempt to remove device 100 from bottle 94 (FIG. 12) is hindered in part by fingers 128. This is due to the engagement between fingers 128 and sidewall 104, which adds strength to help prevent deformation of device 100 by twisting or bending forces. Further, the close proximity of strengthening fingers 128 to inner member sidewall 148 helps prevent such deformation by such forces because inward movement of outer member sidewall 104 and finger 128 is limited by an interfering engagement between fingers 128 and inner member sidewall 148, which is further strengthened against inward movement by its connection to inner member top wall 150. This configuration helps prevent substantial twisting or bending forces from unlocking engaging fingers 126 from inner member 146. Thus, strengthening or seat fingers 128 have a dual purpose in strengthening as just described and as a seat for cover base 184 as noted above.

Figure 17:
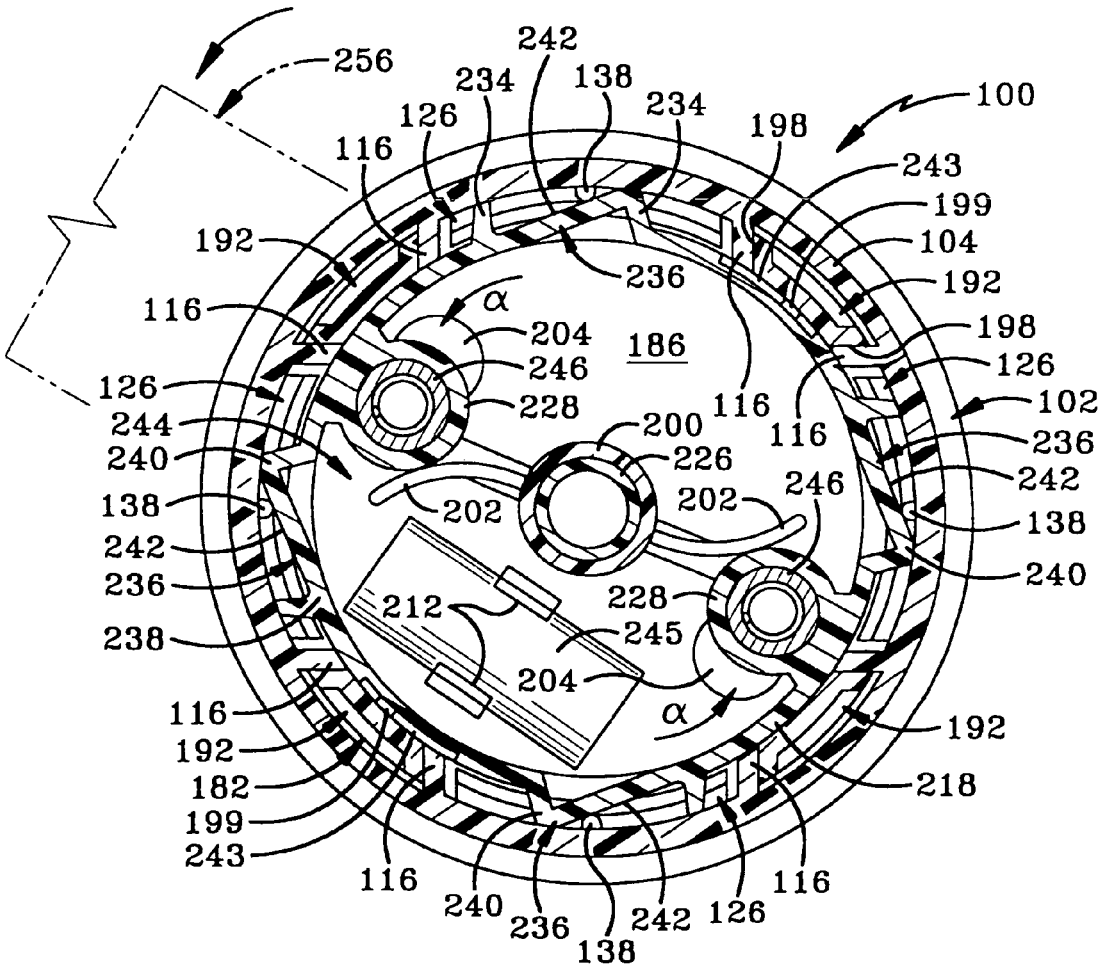
FIG. 17 is a view similar to FIG. 16 but showing the cover cap in a rotated position.

The unlocking mechanism and procedures are illustrated in FIGS. 14-19. As noted above, cover assembly 182 is in the locked position in FIG. 14, wherein pistons 246 are partially disposed in locking depressions 204 in cover base 184. To unlock device 100, key 256 (FIG. 13) is placed atop cover cap 214 with alignment knobs 258 disposed in respective alignment holes 224 (FIG. 15). Magnets 160 attract pistons 246 and compress springs 248 so that pistons 246 move upwardly out of locking depressions 204 so that cover assembly 182 has moved from the locked position to the unlocked position, thus allowing rotation of cover cap 214 with respect to cover base 184. It will be appreciated that locking depressions may alternately be formed on the inside of outer member sidewall 104 and pistons 246 may be situated to move radially outwardly and inwardly to lock and unlock the cover cap. Rotational force is then applied via the engagement of alignment tabs 258 of key 256 with alignment holes 224 of cover cap 214 to rotate cover cap 214 from a non-rotated position (FIG. 16) to a rotated position (FIG. 17). Thus, cover assembly 182 moves from the locked position to the unlocked while in the non-rotated position. As noted before, tabs 188 of cover base 184 act as stops which engage camming arms 230 to prevent cover cap 214 from rotating to the extent that spring arms 202 may be damaged or the EAS tag 245 may be displaced. The rotation of cover cap 214 in the direction of arrows a shown in FIG. 17 causes cam followers 138 to ride along camming surfaces 242 of camming arms 230, which moves cam followers 138 and engaging fingers 126 outwardly, disengaging teeth 136 of engaging fingers 126 from teeth 168 of inner member 146. It will be appreciated that instead of cover cap 214 having camming surface 242, cam follower 138 or engaging finger 126 may have a camming surface which will engage a portion of cover cap 214 upon rotation thereof to move engaging finger 126 so as to disengage from inner member 146.

Figure 18:
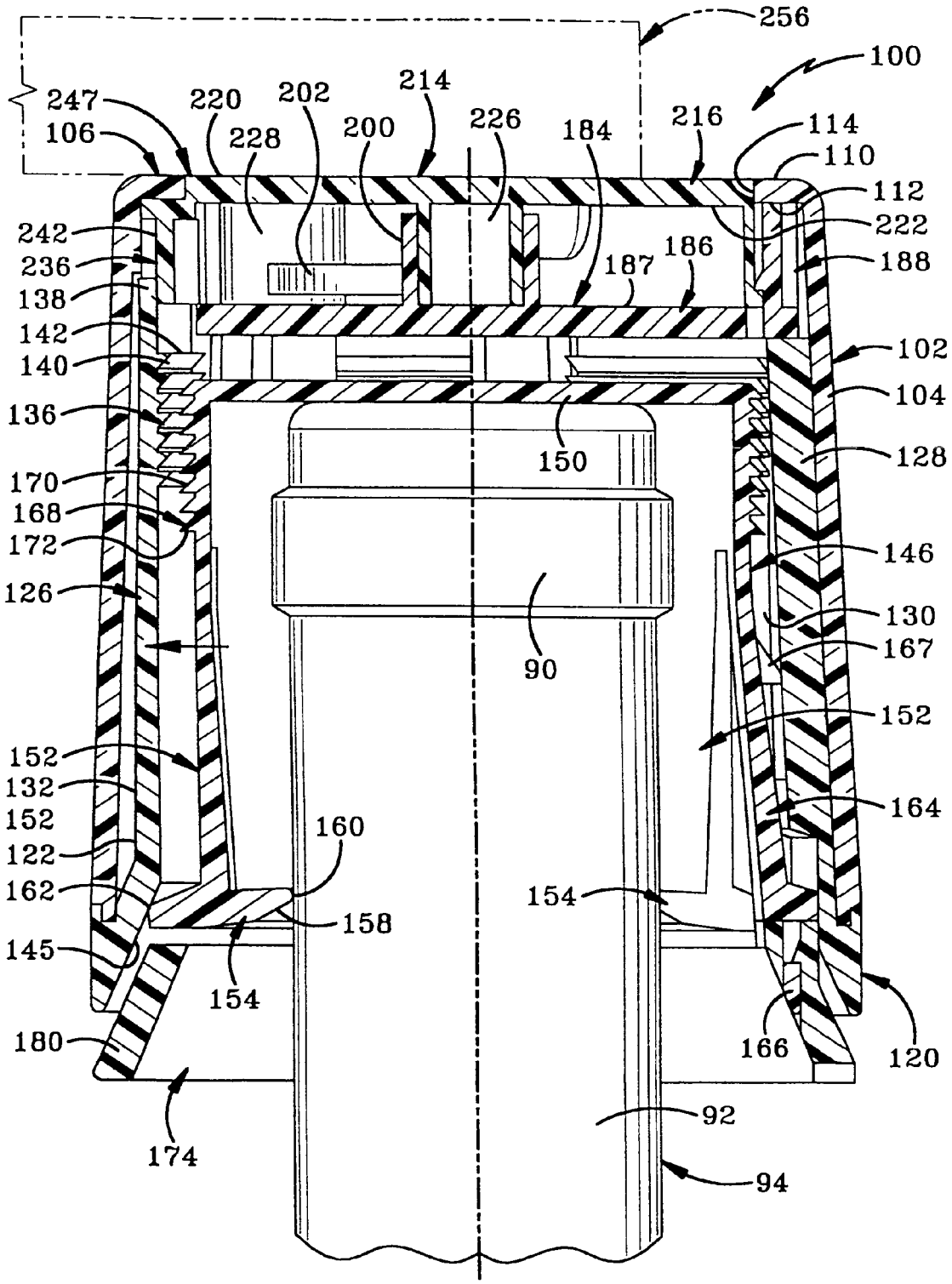
FIG. 18 is a view similar to FIG. 11 but showing the cover cap in the rotated position and the engaging fingers disengaged from the inner member.
Figure 19:
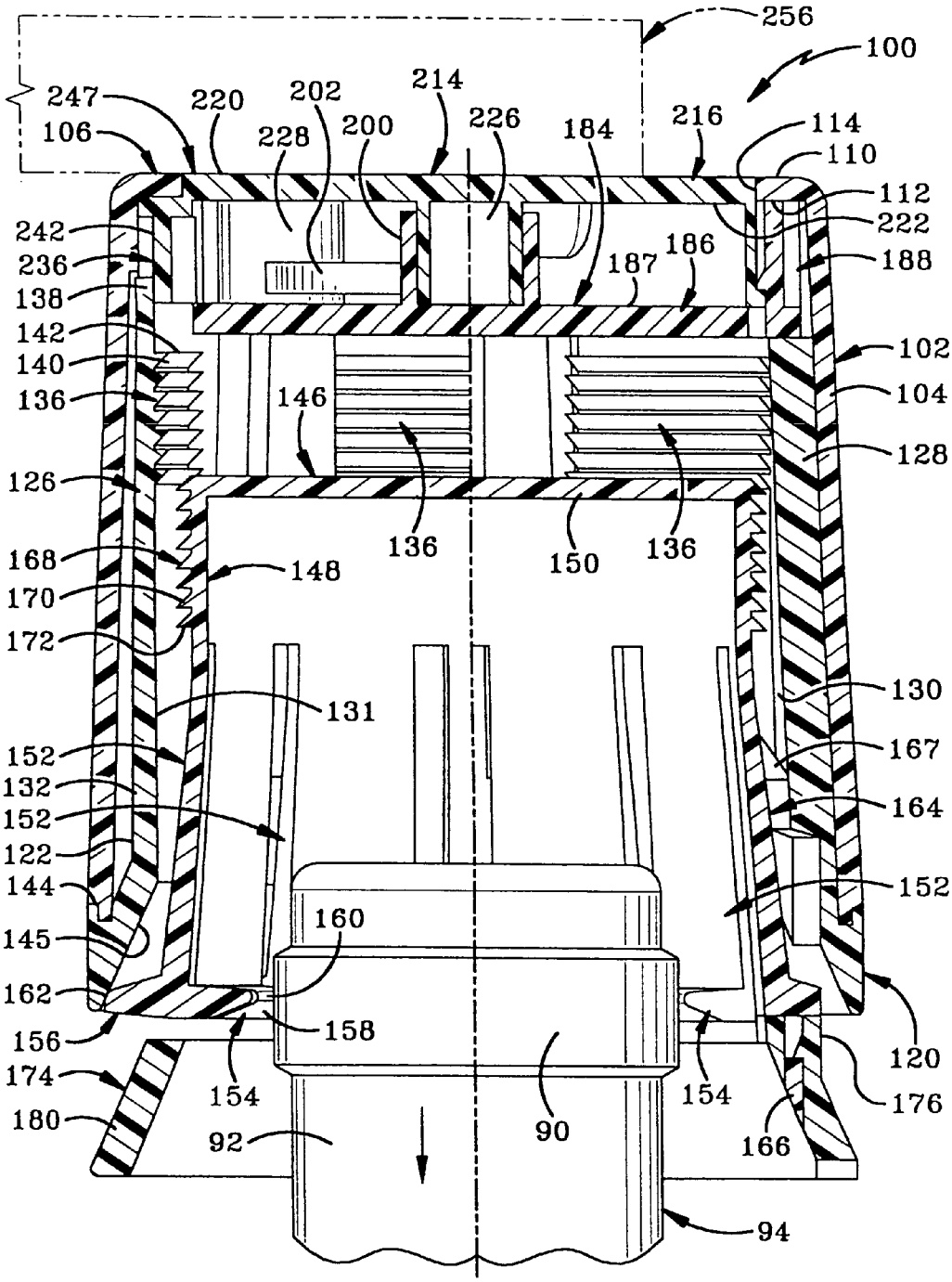
FIG. 19 is similar to FIG. 18 except the inner member has moved partially out of the intermediate member and the locking fingers of the inner member have moved away from the bottle neck to unlock the device to allow the bottle neck to be removed from the device.

At this stage, cover assembly 182 is in the rotated position and device 100 is in a disengaged position (FIGS. 17-19). As shown in FIG. 19, this disengagement allows inner member 146 to move downwardly with respect to intermediate member 120 so that locking fingers 152 of inner member 146 move radially outwardly into the security device unlocked position, whereby bottle neck 92 may be removed from device 100. Preferably, the downward movement of inner member 146 to the unlocked position occurs automatically once teeth 126 have disengaged from teeth 168. This is due in part to the resilient nature of locking fingers 152 applying radially outward pressure via outer shoulders 156 against tapered camming surface 145 of intermediate member 120. Camming surface 145 has an angle sufficient to enable this movement. This automatic movement is also due in part to the slippery interface between outer shoulders 156 and intermediate member 120.

Once key 256 is placed on cover cap 214, it is magnetically held in place on cover cap 214 until sufficient force is provided to remove it. Once inner member 146 moves into the device unlocked position, key 256 may simply be released and cover cap 214, with key 256 still magnetically held in place, will return to the cover assembly unlocked position wherein pistons 246 are disposed above locking depressions 204 in cover base 184. This automatic return of cover cap 214 is due to engagement between resilient arm springs 202 of cover base 184 with housings 228 of cover cap 214. Arm springs 202 are displaced from their resting position by housings 228 when cover cap 214 is rotated by key 256 to unlock device 100. When the force which rotated cover cap 214 is removed, resilient arm springs 202 spring back to their resting position and in so doing press against housings 228 to rotate cover cap 214 back to the cover assembly unlocked position. Removing key 256 from cover cap 214 removes the magnetic attraction so that springs 248 extend and pistons 246 reenter locking depressions 204, thus returning to the cover assembly locked position. Locking device 100 may then be reused on another suitable bottle 94. Springs 248 are preferably metal coil springs, but may be any material that is sufficiently resilient, compressible and extensible to perform the related functions. For example, a plastic spring or appropriate foams may be used.

Alternately, once device 100 has been unlocked, key 256 may be removed from cover cap 214 in the rotated position instead of first allowing cover cap 214 to rotate back to the non-rotated position and unlocked position. Even upon removal of key 256 in the rotated position, cover cap 214 will automatically return to the non-rotated position and the cover assembly locked position. In this alternate scenario, the removal of key 256 allows springs 248 to extend and pistons 246 to move back toward wall 186 of cover base 184. Simultaneously, or nearly so, arm springs 202 begin to move cover cap 214 back toward the non-rotated position. Even where pistons 246 make contact with wall 186 of cover base 184 before arms springs 202 move cover cap 214 fully back to the non-rotated position, pistons 246 successfully reenter locking depressions 204 automatically to achieve the cover assembly locked position. This is due to smooth nature upper surface 187 of wall 186, which allows pistons 246 to smoothly slide back into locking depressions 204. The flat nature of surface 187 in the area where pistons 246 may make contact therewith additionally facilitates this smooth sliding movement.

It will be appreciated that spring arms 202 may be replaced with apparatus performing the same function, such as coil springs in housings positioned to engage housings 228, although spring arms 202 are preferred in that they are compact and may be formed of molded plastic integrally with cover base 184. Further, spring arms 202 or an analogous member may be eliminated without departing from the spirit of the invention although doing so will take away the automatic return function whereby cap cover 214 returns from the rotated position to the non-rotated and locked positions. The return function can be achieved by manually rotating cap cover 214.

Thus, the present invention provides a bottle security device which has two unlocking steps, adding to the difficulty in defeating device 100. First cover assembly 182 itself must be unlocked and then engaging fingers 126 must be disengaged to allow locking fingers 152 to move to the device unlocked position. As more fully described above, pistons 246 must first be withdrawn from locking depressions 204 in cover base 184. Then, cover cap 214 must be rotated to unlock device 100. This sequence requires a suitably strong and properly aligned magnet to withdraw the pistons. The use of at least two pistons 246 provides a redundancy factor so that even if only one piston 246 is not withdrawn, cover cap 214 may not be rotated. In addition, upper surface 220 of cover cap top wall 216 is essentially level with upper surface 110 of outer member top wall 106, which makes rotating cover cap 214 more difficult because there is nothing projecting outwardly which may be grasped to apply a rotating force. Even when cover cap 214 projects slightly above outer member 102, there is still little to grasp. While a potential shoplifter may insert something in keyholes 224 in cover cap 214 to facilitate rotation of cover cap 214, magnets must be simultaneously aligned with pistons 246, which complicates the task without the use of key 256. The task is further complicated by spring arms 202 on cover base 184. More specifically, when cover cap 214 is rotated, housings 228 on cover cap 214 engage spring arms 202, which provide a resistance requiring some force to rotate cover cap 214. While this force is easily manageable with a proper key, it makes the unauthorized unlocking of device 100 more difficult.

EAS tag 245 may be disposed in various locations on device 100 such that the EAS tag 245 may not be removed from device 100 and thus bottle 94 when device 100 is in the locked position on bottle 94. Preferably, EAS tag 245 is disposed in enclosure 244, as earlier noted. In addition, however, EAS tag 245 may be disposed on the inwardly facing surface of wall 186 of cover base 184. EAS tag 245 may also be disposed on the upwardly facing surface of top wall 150 of inner member 146. An alternative location for EAS tag 245 is the inwardly facing surface of top wall 150 of inner member 146. In other embodiments of the present invention, EAS tag 245 may be disposed between engaging fingers 126 or seat fingers 128 and the inwardly facing surface of sidewall 104 of outer member 102. In each of these locations, EAS tag 245 may not be removed by the prospective shoplifter when bottle security device 100 is locked on bottle 94. Preferably, however, EAS tag 245 is not disposed between strengthening fingers 128 and outer member sidewall 104, as the strengthening effect of fingers 128 is most effective when in direct contact with sidewall 104.

Security device 100 may be configured to fit bottles 94 having different neck 92 sizes by adjusting the size of shoulders 154 and 156 of locking fingers 152. For instance, when device 100 is to be used with a bottle having a thin neck 92, the radial length of inner shoulders 154 is increased. When device 100 is used with a bottle having a thick neck 92, the radial dimension of shoulders 154 is reduced. Similarly, the radial dimension of outer shoulders 156 may be adjusted. Of course, the overall size of 100 may also be varied to accommodate different size bottles 94, but adjusting shoulders 154 and 156 as described allows such an adjustment without changing the remaining parts of device 100.

Ring member 174 has a thickness substantial enough to help prevent a thief from accessing locking fingers 152 with a pry bar. Ring member 174 also provides the user of device 100 an alternate means of manipulating inner member 146 once intermediate member 120 and outer member 102 are placed over inner member 146. This allows the user to more easily push inner member 146 fully into intermediate member 120 to ensure full engagement of the locking mechanism.

It will appreciated that device 100 may be formed without a cover base without departing from the spirit of the invention. For instance, this may be accomplished by the use of an intermediate member formed with a top wall which includes the key elements of cover base 184, that is, hollow cylinder 200, spring arms 202 and locking depressions 204. This configuration still allows the device to work essentially as described while eliminating the use of cover base 184. In the preferred embodiment, cover base 184 is used in part to facilitate the molding of the plastic members making up device 100.

In the foregoing description, certain terms have been used for brevity, clearness, and understanding. No unnecessary limitations are to be implied therefrom beyond the requirement of the prior art because such terms are used for descriptive purposes and are intended to be broadly construed.

Moreover, the description and illustration of the invention is an example and the invention is not limited to the exact details shown or described.

The invention claimed is:

1. A bottle security device for use with a bottle having a neck, the bottle security device comprising:

an outer member defining a cavity;

a plurality of fingers which project upwardly within the outer member cavity and define therebetween a cavity;

an inner member including a body and a plurality of locking fingers which extend therefrom and are adapted to fit around at least a portion of the neck of the bottle; the inner member being movable between locked and unlocked positions; a portion of the inner member being disposed in the outer member cavity; a portion of the inner member being disposed within the cavity defined by the upwardly projecting fingers; the locking fingers being disposed radially inwardly of the upwardly projecting fingers; and a rotatable member for unlocking the device in response to rotation of the rotatable member.

2. The device of claim 1 wherein the body of the inner member includes a sidewall defining a cavity.

3. The device of claim 1 wherein the outer member has a sidewall bounding the outer member cavity; and wherein the upwardly projecting fingers are disposed between the outer member sidewall and the inner member.

4. The device of claim 1 in combination with the bottle having the neck; wherein the locking fingers fit around and lockably engage the neck when the device is locked on the neck of the bottle.

5. The combination of claim 4 wherein the device is secured to the neck of the bottle when the inner member is in the locked position with the locking fingers lockably engaging the neck of the bottle; and wherein the device is removable from the neck of the bottle when the inner member is in the unlocked position.

6. A bottle security device for use with a bottle having a neck, the bottle security device comprising:

an outer member defining a cavity;

a plurality of fingers which project upwardly within the outer member cavity and define therebetween a cavity;

an inner member including a body and a plurality of locking fingers which extend therefrom and are adapted to fit around at least a portion of the neck of the bottle; the inner member being movable between locked and unlocked positions; a portion of the inner member being disposed in the outer member cavity; a portion of the inner member being disposed within the cavity defined by the upwardly projecting fingers; and a rotatable member for unlocking the device in response to rotation of the rotatable member;

wherein the upwardly projecting fingers are configured to lock the inner member in the locked position.

7. The device of claim 6 wherein the upwardly projecting fingers include engaging fingers which engage the inner member to lock the inner member in the locked position.

8. The device of claim 6 wherein the upwardly projecting fingers are moved from a first position in contact with the inner member to a second position out of contact with the inner member in response to rotation of the rotatable member.

9. A bottle security device for use with a bottle having a neck, the bottle security device comprising:

an outer member defining a cavity;

a plurality of fingers which project upwardly within the outer member cavity and define therebetween a cavity;

an inner member including a body and a plurality of locking fingers which extend therefrom and are adapted to fit around at least a portion of the neck of the bottle; the inner member being movable between locked and unlocked positions; a portion of the inner member being disposed in the outer member cavity; a portion of the inner member being disposed within the cavity defined by the upwardly projecting fingers; and a rotatable member for unlocking the device in response to rotation of the rotatable member;

wherein the outer member has a sidewall bounding the outer member cavity; and wherein the upwardly projecting fingers are connected to and project upwardly from the outer member sidewall.

10. The device of claim 9 wherein the upwardly projecting fingers angle upwardly and inwardly.

11. A bottle security device for use with a bottle having a neck, the bottle security device comprising:

an outer member defining a cavity;

a plurality of fingers which project upwardly within the outer member cavity and define therebetween a cavity;

an inner member including a body and a plurality of locking fingers which extend therefrom and are adapted to fit around at least a portion of the neck of the bottle; the inner member being movable between locked and unlocked positions; a portion of the inner member being disposed in the outer member cavity; a portion of the inner member being disposed within the cavity defined by the upwardly projecting fingers; and a rotatable member for unlocking the device in response to rotation of the rotatable member;

wherein the upwardly projecting fingers angle upwardly and inwardly.

12. A bottle security device for use with a bottle having a neck, the bottle security device comprising:

an outer member defining a cavity;

a plurality of fingers which project upwardly within the outer member cavity and define therebetween a cavity;

an inner member including a body and a plurality of locking fingers which extend therefrom and are adapted to fit around at least a portion of the neck of the bottle; the inner member being movable between locked and unlocked positions; a portion of the inner member being disposed in the outer member cavity; a portion of the inner member being disposed within the cavity defined by the upwardly projecting fingers; and a rotatable member for unlocking the device in response to rotation of the rotatable member;

wherein a portion of each of the upwardly projecting fingers is moved radially in response to rotation of the rotatable member to unlock the device.

13. The device of claim 12 wherein the portion of each of the upwardly projecting finger is moved radially outwardly in response to rotation of the rotatable member to unlock the device.

14. A bottle security device for use with a bottle having a neck, the bottle security device comprising:

an outer member defining a cavity;

a plurality of fingers which project upwardly within the outer member cavity and define therebetween a cavity;

an inner member including a body and a plurality of locking fingers which extend therefrom and are adapted to fit around at least a portion of the neck of the bottle; the inner member being movable between locked and unlocked positions; a portion of the inner member being disposed in the outer member cavity; a portion of the inner member being disposed within the cavity defined by the upwardly projecting fingers;

a rotatable member for unlocking the device in response to rotation of the rotatable member;

wherein a portion of the upwardly projecting fingers are moved in response to rotation of the rotatable member to unlock the device; and wherein the rotatable member engages and moves the upwardly projecting fingers to unlock the device.

15. The device of claim 14 further comprising a plurality of first camming surfaces respectively on the upwardly projecting fingers; and a plurality of second camming surfaces on the rotatable member which respectively slidably engage the first camming surfaces during rotation of the rotatable member to move a portion of each upwardly projecting finger to unlock the device.

16. A bottle security device for use with a bottle having a neck, the bottle security device comprising:

an outer member defining a cavity; the outer member having a sidewall bounding the outer member cavity;

a plurality of fingers which project upwardly within the outer member cavity and define therebetween a cavity;

an inner member including a body and a plurality of locking fingers which extend therefrom and are adapted to fit around at least a portion of the neck of the bottle; the inner member being movable between locked and unlocked positions; a portion of the inner member being disposed in the outer member cavity; a portion of the inner member being disposed within the cavity defined by the upwardly projecting fingers;

a rotatable member for unlocking the device in response to rotation of the rotatable member;

wherein the upwardly projecting fingers are disposed between the outer member sidewall and the locking fingers of the inner member.

17. A bottle security device for use with a bottle having a neck, the bottle security device comprising:

an outer member defining a cavity; the outer member having a sidewall bounding the outer member cavity;

a plurality of fingers which project upwardly within the outer member cavity and define therebetween a cavity;

an inner member including a body and a plurality of locking fingers which extend therefrom and are adapted to fit around at least a portion of the neck of the bottle; the inner member being movable between locked and unlocked positions; a portion of the inner member being disposed in the outer member cavity; a portion of the inner member being disposed within the cavity defined by the upwardly projecting fingers;

a rotatable member for unlocking the device in response to rotation of the rotatable member;

wherein the body of the inner member includes a sidewall defining a cavity; and wherein the upwardly projecting fingers are disposed between the outer member sidewall and the inner member sidewall.

18. A bottle security device for use with a bottle having a neck, the bottle security device comprising:

an outer member defining a cavity; the outer member having a sidewall bounding the outer member cavity;

a plurality of fingers which project upwardly within the outer member cavity and define therebetween a cavity;

an inner member including a body and a plurality of locking fingers which extend therefrom and are adapted to fit around at least a portion of the neck of the bottle; the inner member being movable between locked and unlocked positions; a portion of the inner member being disposed in the outer member cavity; a portion of the inner member being disposed within the cavity defined by the upwardly projecting fingers;

a rotatable member for unlocking the device in response to rotation of the rotatable member;

wherein the upwardly projecting fingers are disposed between the outer member sidewall and the inner member; and wherein the outer member sidewall has an inner surface; and wherein the upwardly projecting fingers include strengthening fingers which abut the inner surface of the outer member sidewall.

19. The device of claim 18 wherein the upwardly projecting fingers include engaging fingers which engage the inner member to lock the inner member in the locked position.

20. A method comprising the steps of:

rotating a rotatable member to unlock an inner member having a body and a plurality of locking fingers extending therefrom to allow the inner member to move from a locked position in which the locking fingers are adapted to fit around a portion of the neck of a bottle and lockably engage the neck of the bottle to an unlocked position adapted to allow removal of the bottle from between the locking fingers wherein a portion of the inner member is disposed within a cavity defined by a plurality of upwardly projecting fingers which are disposed within a cavity defined by an outer member and wherein the a portion of the inner member is disposed within the outer member cavity; and moving the entire inner member downwardly with respect to the outer member from the locked position to the unlocked position.

21. The method of claim 20 further comprising the step of unlocking the device to disengage the locking fingers from the neck of the bottle; and removing the bottle from between the locking fingers.

22. The method of claim 20 wherein the step of rotating further includes the step of moving the inner member from the locked position to the unlocked position in response to rotation of the rotatable member.

23. A method comprising the steps of:

rotating a rotatable member to unlock an inner member having a body and a plurality of locking fingers extending therefrom to allow the inner member to move from a locked position in which the locking fingers are adapted to fit around a portion of the neck of a bottle and lockably engage the neck of the bottle to an unlocked position adapted to allow removal of the bottle from between the locking fingers wherein a portion of the inner member is disposed within a cavity defined by a plurality of upwardly projecting fingers which are disposed within a cavity defined by an outer member and wherein the a portion of the inner member is disposed within the outer member cavity; and wherein the step of rotating includes moving a plurality of the upwardly projecting fingers out of locking engagement with the inner member in response to rotation of the rotatable member to unlock the inner member.

24. The method of claim 23 further including the step of moving the entire inner member downwardly with respect to the outer member from the locked position to the unlocked position.

25. A bottle security device for use with a bottle having a neck, the bottle security device comprising:

an outer member defining a cavity;

a plurality of fingers which project upwardly within the outer member cavity and define therebetween a cavity;

an inner member having upper and lower ends and including a body and a plurality of locking fingers which extend therefrom and are adapted to fit around at least a portion of the neck of the bottle; the inner member being movable between locked and unlocked positions; a portion of the inner member being disposed in the outer member cavity; a portion of the inner member being disposed within the cavity defined by the upwardly projecting fingers;

a rotatable member for unlocking the device in response to rotation of the rotatable member; and wherein the upwardly projecting fingers extend upwardly from adjacent the lower end of the inner member.

26. A bottle security device for use with a bottle having a neck, the bottle security device comprising:

an outer member defining a cavity;

a plurality of fingers which project upwardly within the outer member cavity and define therebetween a cavity;

an inner member comprising a top wall, a sidewall which is connected to and extends downwardly from the top wall and a plurality of locking fingers which extend downwardly from the sidewall and are adapted to fit around at least a portion of the neck of the bottle; the inner member being movable between locked and unlocked positions; a portion of the inner member being disposed in the outer member cavity; a portion of the inner member being disposed within the cavity defined by the upwardly projecting fingers; and a rotatable member for unlocking the device in response to rotation of the rotatable member; and wherein the upwardly projecting fingers extend from below the top wall of the inner member to above the top wall of the inner member.

27. A bottle security device for use with a bottle having a neck, the bottle security device comprising:

an outer member defining a cavity;

a plurality of fingers which project upwardly within the outer member cavity and define therebetween a cavity;

an inner member comprising a sidewall defining a cavity, a top wall which is connected to and extends radially inwardly from the sidewall and a plurality of locking fingers which are connected to and extend downwardly from the sidewall and are adapted to fit around at least a portion of the neck of the bottle; the inner member being movable between locked and unlocked positions; a portion of the inner member being disposed in the outer member cavity; a portion of the inner member being disposed within the cavity defined by the upwardly projecting fingers; the inner member top wall in its entirety being disposed radially inward of the upwardly projecting fingers; and a rotatable member for unlocking the device in response to rotation of the rotatable member.

28. A bottle security device for use with a bottle having a neck, the bottle security device comprising:

an outer member defining a cavity;

a plurality of fingers which project upwardly within the outer member cavity and define therebetween a cavity;

an inner member including a body and a plurality of locking fingers which extend therefrom and are adapted to fit around at least a portion of the neck of the bottle; the inner member being movable between locked and unlocked positions; a portion of the inner member being disposed in the outer member cavity; a portion of the inner member being disposed within the cavity defined by the upwardly projecting fingers; the entire inner member being movable downwardly with respect to the outer member from the locked position to the unlocked position; and a rotatable member for unlocking the device in response to rotation of the rotatable member.

29. A bottle security device for use with a bottle having a neck, the bottle security device comprising:

an outer member defining a cavity;

a plurality of fingers which project upwardly within the outer member cavity and define therebetween a cavity;

an inner member including a body and a plurality of locking fingers which extend therefrom and are adapted to fit around at least a portion of the neck of the bottle; the inner member being movable between locked and unlocked positions; a portion of the inner member being disposed in the outer member cavity; a portion of the inner member being disposed within the cavity defined by the upwardly projecting fingers;

a rotatable member for unlocking the device in response to rotation of the rotatable member; and a magnetically actuated locking mechanism having locked and unlocked positions for respectively preventing and allowing rotation of the rotatable member.

30. The device of claim 29 wherein the locking mechanism comprises at least one piston which is movable relative to the rotatable member and an additional member of the device between a first position in which the at least one piston creates an interference between the rotatable member and the additional member when in the locked position of the locking mechanism to prevent rotation of the rotatable member and a second position in which the interference is eliminated.

31. The device of claim 29 wherein a force must be applied to rotate the rotatable member from a non-rotated position to a rotated position to unlock the device; and wherein the rotatable member automatically rotatably returns to the non-rotated position when the force is removed.

* * * * *